United States Patent [19]

Hamano et al.

[11] Patent Number: 5,046,735

[45] Date of Patent: Sep. 10, 1991

[54] SYMBOL ASSORTING GAMING MACHINE

[75] Inventors: Junichi Hamano, Hyogo, Japan; Michael Wood, Denham Springs, La.; Lee Dunlap; Terry Wilson, both of Baton Rouge, La.

[73] Assignee: Takasago Electric Industry Co., Ltd., Osaka, Japan

[21] Appl. No.: 419,934

[22] Filed: Oct. 11, 1989

[30] Foreign Application Priority Data

Jun. 28, 1989 [JP] Japan ..... 1-166100

[51] Int. Cl.[5] ..... A63F 9/00; A63F 9/22

[52] U.S. Cl. ..... 273/85 CP; 273/138 A; 434/129

[58] Field of Search ..... 273/138 A, 143 R, 85 CP; 364/412; 434/128, 129

[56] References Cited

U.S. PATENT DOCUMENTS

| | | | |
|---|---|---|---|
| 3,628,259 | 12/1971 | Kahn | 434/129 |
| 3,962,800 | 6/1976 | Feldheim | 434/129 |
| 4,760,527 | 7/1988 | Sidley | 273/85 CP |
| 4,799,683 | 1/1989 | Bruner, Jr. | 273/85 CP |

FOREIGN PATENT DOCUMENTS

| | | | |
|---|---|---|---|
| 2097160 | 9/1982 | United Kingdom | 273/138 A |
| 2135490 | 8/1984 | United Kingdom | 273/143 R |
| 2165385 | 4/1986 | United Kingdom | 273/143 R |
| 2170938 | 8/1986 | United Kingdom | 273/143 R |
| 8402281 | 6/1984 | World Int. Prop. O. | 273/138 A |

*Primary Examiner*—Edward M. Coven
*Assistant Examiner*—Jessica J. Harrison
*Attorney, Agent, or Firm*—Jordan and Hamburg

[57] ABSTRACT

The present invention relates to a symbol assorting gaming machine for playing a poker game on a display screen, in which when playing the symbol assorting game by holding one or more symbols among a predetermined number of symbols displayed and replacing the rest with the other symbols, an optimum holding object is calculated in response to the probability calculation so as to be instructed to the player, thereby an interest of the game is stimulated not only for a proficient but also for a beginner, and the game can be mastered in a short time.

6 Claims, 37 Drawing Sheets

FIG.3
| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| 4 KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| 3 KIND | 3 | 6 | 9 | 12 | 15 |
| 2 PAIR | 2 | 4 | 6 | 8 | 10 |
| PAIR | 1 | 2 | 3 | 4 | 5 |
FIG.4
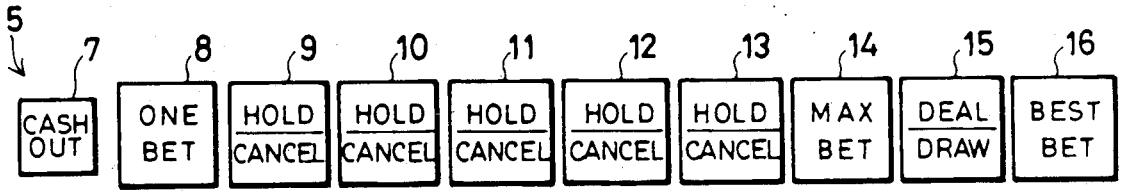
FIG.5
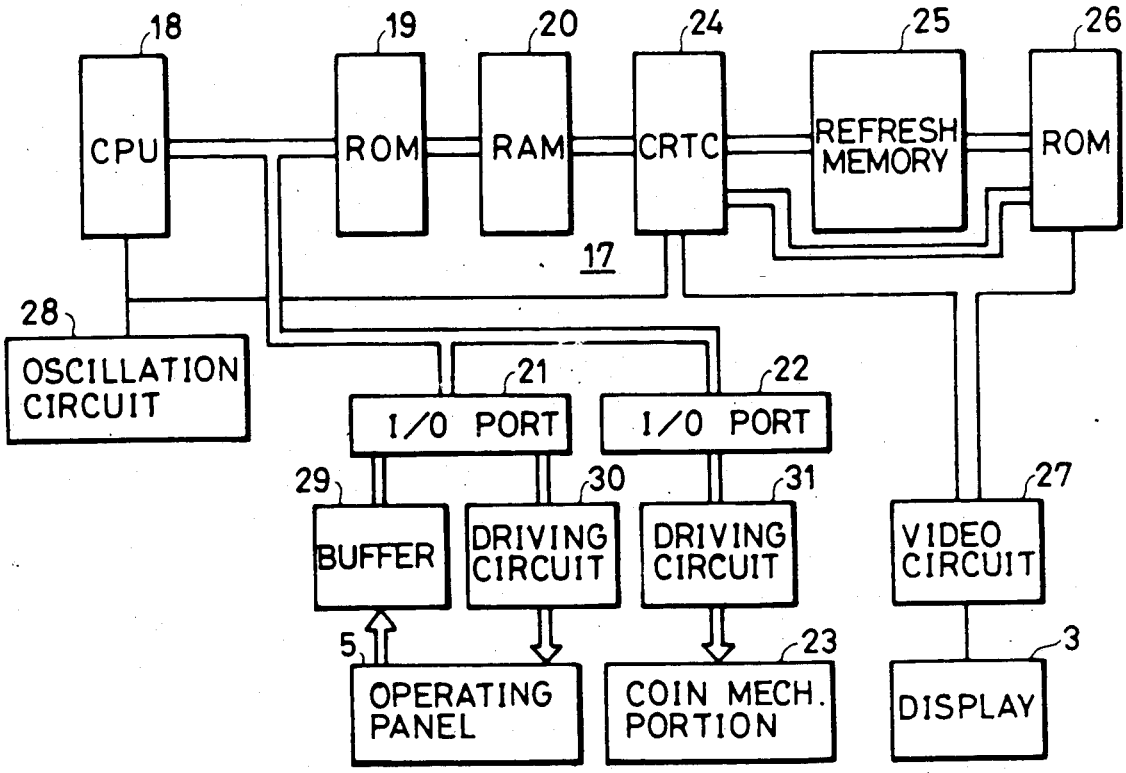

FIG.11

| | | |
|---|---|---|
| C-0 | NULL | 1230195 |
| | PAIR | 184944 |
| | 2P | 73683 |
| | 3K | 33075 |
| | ST | 5892 |
| | FL | 3464 |
| | FH | 2271 |
| | 4K | 387 |
| | SF | 25 |
| | RSF | 3 |
| | | |
| C-1 | NULL | 153249 |
| | PAIR | 13962 |
| | ⋮ | ⋮ |
| | 4K | 9 |
| | SF | 5 |
| | RSF | 0 |
| | | |
| | | |
| | | |
| C-31 | NULL | 1 |
| | PAIR | 0 |
| | 2P | 0 |
| | 3K | 0 |
| | ST | 0 |
| | FL | 0 |
| | FH | 0 |
| | 4K | 0 |
| | SF | 0 |
| | RSF | 0 |

FIG.15

TB1

| | | | | | | | |
|---|---|---|---|---|---|---|---|
| C - 0 | C - 1 | C - 2 | C - 3 | C - 4 | C - 5 | C - 6 | C - 7 |
| C - 8 | C - 9 | C -10 | C -11 | C -12 | C -13 | C -14 | C -15 |
| C -16 | C -17 | C -18 | C -19 | C -20 | C -21 | C -22 | C -23 |
| C -24 | C -25 | C -26 | C -27 | C -28 | C -29 | C -30 | C -31 |

FIG.17

TB2

| | 2 PAIR | 3 KIND | FULL HOUSE | 4 KIND |
|---|---|---|---|---|
| C - 0 | | | | |
| C - 1 | | | | |
| | | | | |
| | | | | |
| C -30 | | | | |
| C -31 | | | | |

FIG. 19(1)

| m \ n | 0 | | 1 | | 2 | | 3 | | 4 | |
|---|---|---|---|---|---|---|---|---|---|---|
| | CARD 1 | | CARD 2 | | CARD 3 | | CARD 4 | | CARD 5 | |
| 0 | A | 4 | 2 | 4 | 3 | 4 | 4 | 4 | 5 | 4 |
| 1 | 2 | 4 | 3 | 4 | 4 | 4 | 5 | 4 | 6 | 4 |
| 2 | 3 | 4 | 4 | 4 | 5 | 4 | 6 | 4 | 7 | 4 |
| 3 | 4 | 4 | 5 | 4 | 6 | 4 | 7 | 4 | 8 | 4 |
| 4 | 5 | 4 | 6 | 4 | 7 | 4 | 8 | 4 | 9 | 4 |
| 5 | 6 | 4 | 7 | 4 | 8 | 4 | 9 | 4 | 10 | 4 |
| 6 | 7 | 4 | 8 | 4 | 9 | 4 | 10 | 4 | J | 4 |
| 7 | 8 | 4 | 9 | 4 | 10 | 4 | J | 4 | Q | 4 |
| 8 | 9 | 4 | 10 | 4 | J | 4 | Q | 4 | K | 4 |
| 9 | 10 | 4 | J | 4 | Q | 4 | K | 4 | A | 4 |

CTST

FIG. 19(2)

| | 0 | | 1 | | 2 | | 3 | | 4 | |
|---|---|---|---|---|---|---|---|---|---|---|
| | CARD 1 | | CARD 2 | | CARD 3 | | CARD 4 | | CARD 5 | |
| 0 | A | 4 | 2 | 4 | 3 | 4 | 4 | 4 | 5 | 4 |
| 1 | 2 | 4 | 3 | 4 | 4 | 4 | 5 | 4 | 6 | 4 |
| 2 | 3 | 4 | 4 | 4 | 5 | 4 | 6 | 4 | 7 | 4 |
| 3 | 4 | 4 | 5 | 4 | 6 | 4 | 7 | 4 | 8 | 2 |
| 4 | 5 | 4 | 6 | 4 | 7 | 4 | 8 | 2 | 9 | 4 |
| 5 | 6 | 4 | 7 | 4 | 8 | 2 | 9 | 4 | 10 | 3 |
| 6 | 7 | 4 | 8 | 2 | 9 | 4 | 10 | 3 | J | 3 |
| 7 | 8 | 2 | 9 | 4 | 10 | 3 | J | 3 | Q | 4 |
| 8 | 9 | 4 | 10 | 3 | J | 3 | Q | 4 | K | 3 |
| 9 | 10 | 3 | J | 3 | Q | 4 | K | 3 | A | 4 |

CTST

FIG. 19(3)

| | 0 | | 1 | | 2 | | 3 | | 4 | |
|---|---|---|---|---|---|---|---|---|---|---|
| | CARD 1 | | CARD 2 | | CARD 3 | | CARD 4 | | CARD 5 | |
| 0 | A | | 2 | | 3 | | 4 | | 5 | |
| 1 | 2 | | 3 | | 4 | | 5 | | 6 | |
| 2 | 3 | | 4 | | 5 | | 6 | | 7 | |
| 3 | 4 | 4 | 5 | 4 | 6 | 4 | 7 | 4 | 8 | 1 |
| 4 | 5 | 4 | 6 | 4 | 7 | 4 | 8 | 1 | 9 | 4 |
| 5 | 6 | 4 | 7 | 4 | 8 | 1 | 9 | 4 | 10 | 3 |
| 6 | 7 | 4 | 8 | 1 | 9 | 4 | 10 | 3 | J | 3 |
| 7 | 8 | 1 | 9 | 4 | 10 | 3 | J | 3 | Q | 4 |
| 8 | 9 | | 10 | | J | | Q | | K | |
| 9 | 10 | | J | | Q | | K | | A | |

CTST

FIG. 20

| | | | | | | | |
|---|---|---|---|---|---|---|---|
| C-0 | 5920 | C-8 | 96 | C-16 | 0 | C-24 | 0 |
| C-1 | 992 | C-9 | 0 | C-17 | 0 | C-25 | 32 |
| C-2 | 992 | C-10 | 160 | C-18 | 0 | C-26 | 0 |
| C-3 | 608 | C-11 | 96 | C-19 | 32 | C-27 | 0 |
| C-4 | 480 | C-12 | 0 | C-20 | 0 | C-28 | 0 |
| C-5 | 288 | C-13 | 160 | C-21 | 0 | C-29 | 0 |
| C-6 | 0 | C-14 | 96 | C-22 | 32 | C-30 | 0 |
| C-7 | 160 | C-15 | 96 | C-23 | 0 | C-31 | 0 |

FIG. 21 (2)
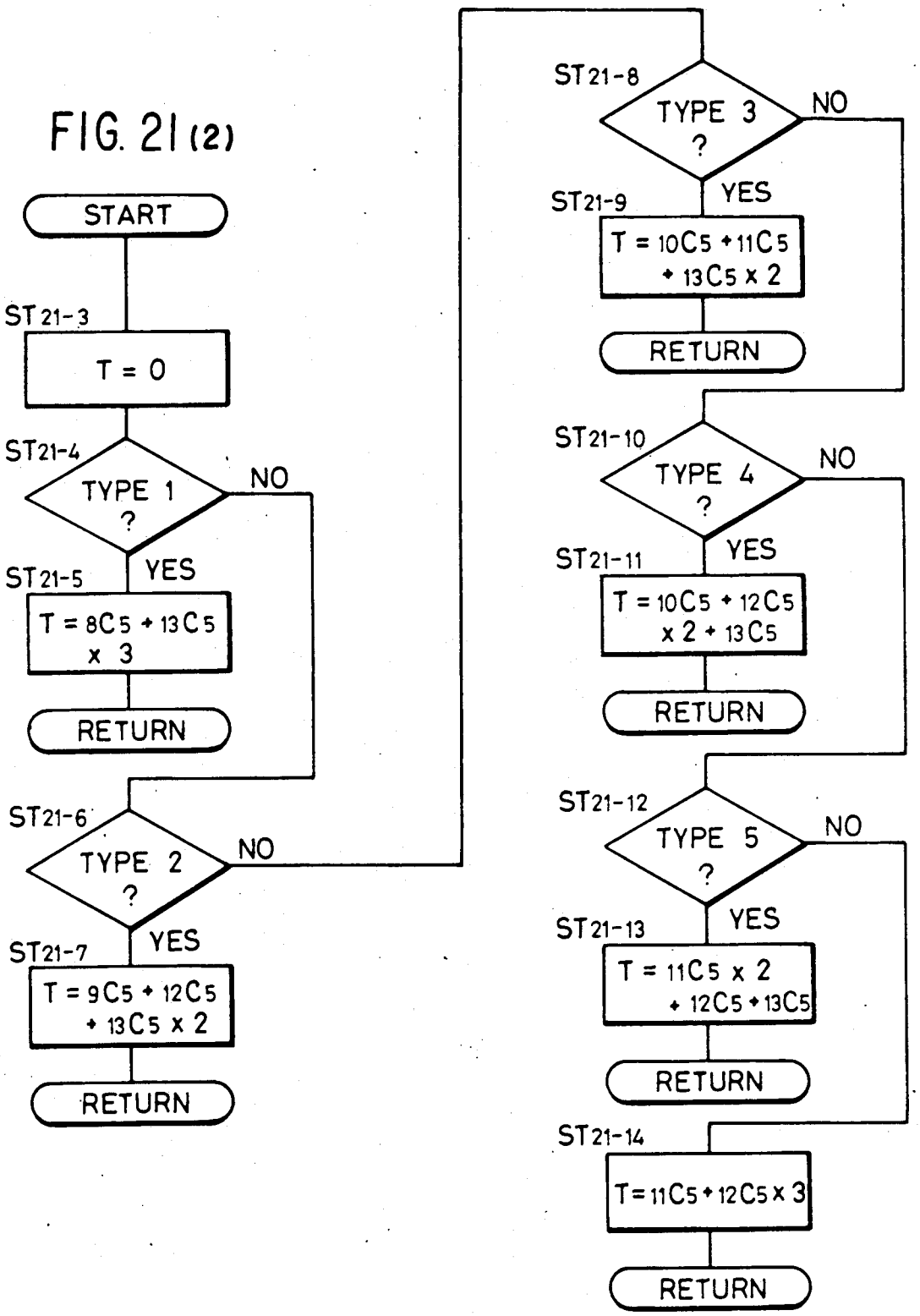

FIG. 22

| | | | | | | | |
|---|---|---|---|---|---|---|---|
| C-0 | 3492 | C-8 | 0 | C-16 | 0 | C-24 | 36 |
| C-1 | 495 | C-9 | 0 | C-17 | 0 | C-25 | 36 |
| C-2 | 126 | C-10 | 84 | C-18 | 0 | C-26 | 0 |
| C-3 | 126 | C-11 | 84 | C-19 | 0 | C-27 | 0 |
| C-4 | 126 | C-12 | 84 | C-20 | 0 | C-28 | 0 |
| C-5 | 126 | C-13 | 84 | C-21 | 0 | C-29 | 0 |
| C-6 | 0 | C-14 | 84 | C-22 | 36 | C-30 | 0 |
| C-7 | 0 | C-15 | 84 | C-23 | 36 | C-31 | 0 |

FIG. 23 (1)
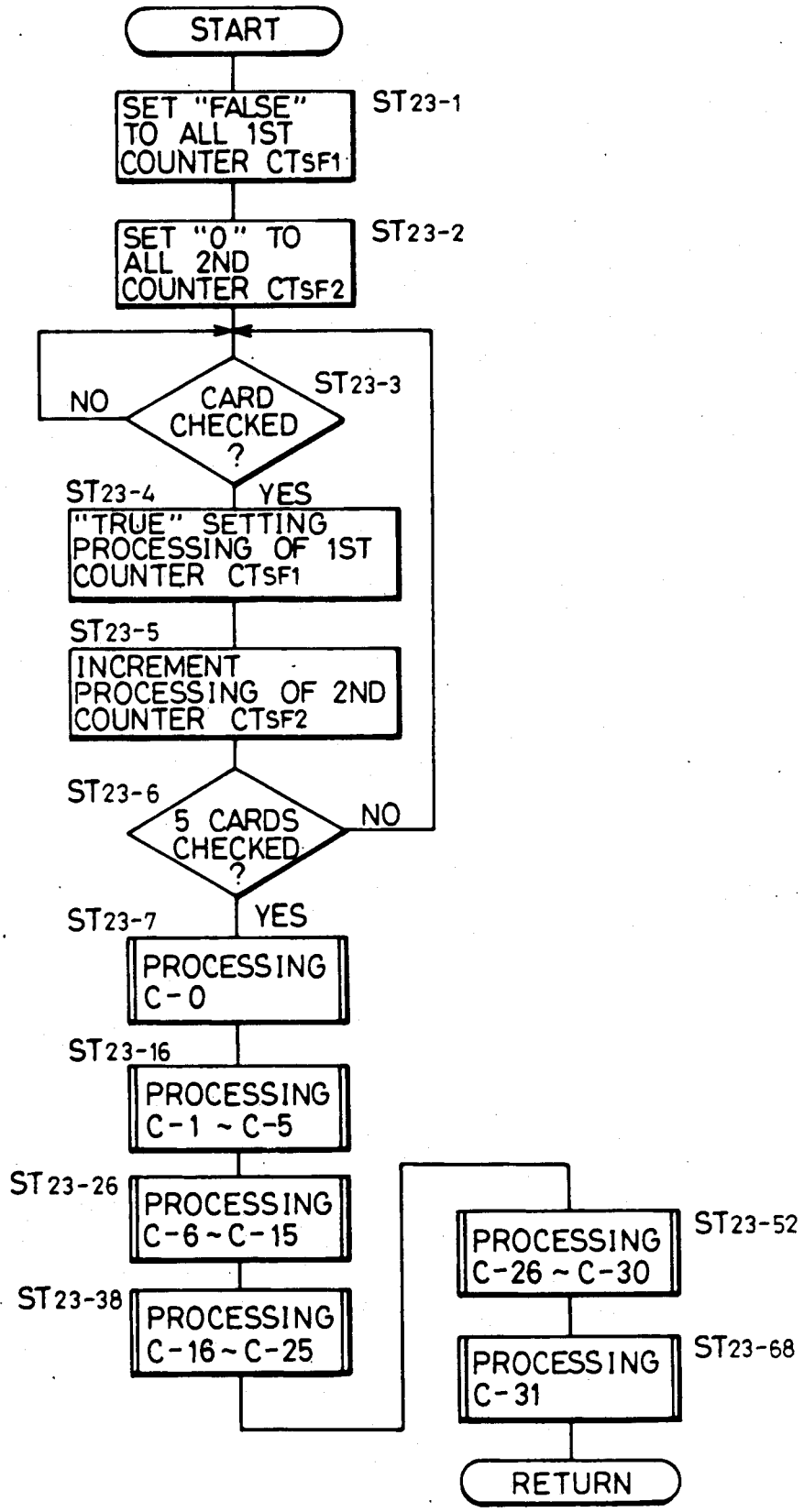

FIG. 24 (1)

| m | n | 0 | 1 | 2 | 3 | 4 | 5 | 6 | 7 | 8 |
|---|---|---|---|---|---|---|---|---|---|---|
| | | A~5 | 2~6 | 3~5 | 4~8 | 5~9 | 6~10 | 7~J | 8~Q | 9~K |
| 0 | 2 | F | F | F | F | F | F | F | F | F |
| 1 | 3 | F | F | F | F | F | F | F | F | F |
| 2 | 4 | F | F | F | F | F | F | F | F | F |
| 3 | 5 | F | F | F | F | F | F | F | F | F |
| 4 | 6 | F | F | F | F | F | F | F | F | F |
| 5 | 7 | F | F | F | F | F | F | F | F | F |
| 6 | 8 | F | F | F | F | F | F | F | F | F |
| 7 | 9 | F | F | F | F | F | F | F | F | F |
| 8 | 10 | F | F | F | F | F | F | F | F | F |
| 9 | J | F | F | F | F | F | F | F | F | F |
| 10 | Q | F | F | F | F | F | F | F | F | F |
| 11 | K | F | F | F | F | F | F | F | F | F |
| 12 | A | F | F | F | F | F | F | F | F | F |

CTSF1

FIG. 24 (2)

| p | | n | 0 | 1 | 2 | 3 | 4 | 5 | 6 | 7 | 8 |
|---|---|---|---|---|---|---|---|---|---|---|---|
| | | | A~5 | 2~6 | 3~7 | 4~8 | 5~9 | 6~10 | 7~J | 8~Q | 9~K |
| 0 | HEART | | 0 | 0 | 0 | 0 | 0 | 0 | 0 | 0 | 0 |
| 1 | DIAMOND | | 0 | 0 | 0 | 0 | 0 | 0 | 0 | 0 | 0 |
| 2 | CLUB | | 0 | 0 | 0 | 0 | 0 | 0 | 0 | 0 | 0 |
| 3 | SPADE | | 0 | 0 | 0 | 0 | 0 | 0 | 0 | 0 | 0 |

CTSF2

FIG. 25 (1)

| m | | n: 0 | 1 | 2 | 3 | 4 | 5 | 6 | 7 | 8 |
|---|---|---|---|---|---|---|---|---|---|---|
| | | A~5 | 2~6 | 3~7 | 4~8 | 5~9 | 6~10 | 7~J | 8~Q | 9~K |
| 0 | 2 | | | | | | | | | |
| 1 | 3 | | | | | | | | | |
| 2 | 4 | | | | | | | | | |
| 3 | 5 | | | | | | | | | |
| 4 | 6 | | | | | | | | | |
| 5 | 7 | | | | | | | | | |
| 6 | 8 | | | | T | T | T | T | T | |
| 7 | 9 | | | | | | | | | |
| 8 | 10 | | | | | | T | T | T | T |
| 9 | J | | | | | | | T | T | T |
| 10 | Q | | | | | | | | | |
| 11 | K | | | | | | | | | |
| 12 | A | | | | | | | | | |

CTSF1

FIG. 25 (2)

| p | | n: 0 | 1 | 2 | 3 | 4 | 5 | 6 | 7 | 8 |
|---|---|---|---|---|---|---|---|---|---|---|
| | | A~5 | 2~6 | 3~7 | 4~8 | 5~9 | 6~10 | 7~J | 8~Q | 9~K |
| 0 | HEART | | | | 1 | 1 | 1 | 1 | 1 | |
| 1 | DIAMOND | | | | 1 | 1 | 2 | 3 | 3 | 3 |
| 2 | CLUB | | | | | | | | | |
| 3 | SPADE | | | | | | | | | |

CTSF2

FIG.26

| | | | | | | | |
|---|---|---|---|---|---|---|---|
| C-0 | 25 | C-8 | 0 | C-16 | 0 | C-24 | 0 |
| C-1 | 5 | C-9 | 0 | C-17 | 0 | C-25 | 1 |
| C-2 | 2 | C-10 | 1 | C-18 | 0 | C-26 | 0 |
| C-3 | 0 | C-11 | 0 | C-19 | 0 | C-27 | 0 |
| C-4 | 0 | C-12 | 0 | C-20 | 0 | C-28 | 0 |
| C-5 | 0 | C-13 | 0 | C-21 | 0 | C-29 | 0 |
| C-6 | 0 | C-14 | 0 | C-22 | 2 | C-30 | 0 |
| C-7 | 0 | C-15 | 0 | C-23 | 0 | C-31 | 0 |

SYMBOL ASSORTING GAMING MACHINE

BACKGROUND OF THE INVENTION

The present invention relates to a symbol assorting gaming machine, in which from a fixed number of various kinds of characters and figures (hereinafter referred to as a symbol), a predetermined number of symbols are extracted optionally and displayed on a display screen, and when one or more among which are held and the rest are replaced with the other symbols which are extracted optionally and displayed, winning or losing of a game is decided by whether or not a symbol combination pattern coincides with a symbol combination pattern related to winning.

Conventionally, as such a gaming machine, a card gaming machine in which a card poker game is displayed and played on a display screen has been realized.

In the card gaming machine, a display portion for displaying the game content such as a CRT and an operating panel provided with a plurality of push-button switches necessary for proceeding with the game are installed in front of the machine, together with a control circuit incorporated therein for executing various calculations and processings necessary for proceeding with the game, while controlling in series the input and output to and from the display portion and operating panel.

In the card gaming machine thus constructed, on the display portion, figures of 5 cards extracted optionally from 52 cards are displayed. The first 5 cards displayed correspond to a dealer of the actual poker game.

The player then operates a predetermined push-button switch on the operating panel to hold one or more cards and replace the rest with the other cards which are extracted optionally. Thereby, on the display portion, new cards extracted optionally are displayed at the replaced positions. Here, the cards to be held correspond to those being kept in hand, and the cards to be replaced correspond to those being released from hand in the actual poker game.

As the result, the control circuit judges whether or not a card combination pattern after replacement coincides with a card combination pattern related to winning (hereinafter referred to as a "winning pattern") to decide the game. Here, the winning pattern corresponds to "Pair", "2 Pair", "Straight", "Flush" etc. in the poker game.

In this type of gaming machine, usually the player plays the game by betting a desired number coins for each game, and the number of coins corresponding to a predetermined dividend are refunded to the player by the winning pattern coincided with the final card combination pattern.

In such a gaming machine, though the issue hangs on which cards to be held among the 5 cards displayed initially, the selection of which card to be held is dependent largely upon a long perception and experience of the player with the gaming machine. As the result, this type of gaming machine is very interesting for a proficient player, but for a beginner it is nothing but a main cause for losing interest.

Though it is the foundation of proficiency with this type of gaming machine to judge how accurately and in what probability each of the wining patterns can be realized from the card combination pattern displayed initially, it is practically impossible the player to calculate for such probability. Therefore, such a problem is encountered that when deciding a holding object, right or wrong thereof can not be judged simply, occupying much time for becoming skilled in the game.

SUMMARY OF THE INVENTION

A symbol assorting gaming machine according to the present invention comprises, displaying means for displaying a predetermined number of symbols extracted optionally among a fixed number of various symbols, holding means for holding one or more symbols among these symbols, replacing means for replacing the symbols other than those being held with the other symbols extracted optionally for display, judging means for judging whether or not a symbol combination pattern after replacement coincides with a symbol combination pattern related to winning, calculating means for calculating in response to the probability calculation on optimum holding object for realizing the symbol combination pattern related to winning from the symbol combination pattern displayed initially, and instructing means for outputting and instructing the calculation result by the calculating means to the player.

Another symbol assorting gaming machine of the present invention comprises, displaying means for display in a predetermined number of symbols extracted optionally among a fixed number of various symbols, holding means for holding one or more symbols among these symbols, replacing means for replacing the symbols other than those being held with the other symbols extracted optionally for display, judging means for judging whether or not a symbol combination pattern after replacement coincides with a symbol combination pattern related to winning, calculating means for calculating in response to the probability calculation an optimum holding object for realizing the symbol combination pattern related to winning from the symbol combination pattern displayed initially, instructing means for outputting and instructing the calculation result by the calculating means to the player, and operating means for demanding instructions by the instructing means.

In the preferred embodiment, the instructing means utilizes means for instructing to the player by a method of distinguishing an optimum holding object among a plurality of symbols displayed by the displaying means from the other symbols visually.

In the separate embodiment, the calculating means including memory means for storing fixed data obtained by the precalculation, first calculating means for executing in part the probability calculation aforementioned by reading the fixed data from the memory means, and second calculating means for executing in part the rest of probability calculation by executing a predetermined calculating procedure.

It is, therefore, a primary object of the present invention to provide a symbol assorting gaming machine, which is interesting not only for a proficient but also for a beginner and enabling becoming skilled in a short time, by providing the function to calculate an optimum holding object in response to the probability calculation so as to be instructed to the player.

The aforesaid objects, features and advantages of the present invention will become more apparent from the following detailed description made with reference to the accompanying drawings.

BRIEF DESCRIPTION OF DRAWINGS

FIG. 3 is an explanatory view showing a specific example of an odds table displayed on a ;display, FIG. 4 is an explanatory view showing the arrangement of push buttons on an operating panel.

FIG. 5 is a block diagram showing the entire configuration of a control circuit.

FIG. 11 is a table illustrating the number of winning combinations and number of non-winning combinations that exist, for several of the holding methods;

FIG. 15 is an explanatory view showing the configuration of a first group table, FIG. 17 is an explanatory view showing the configuration of a second group table, FIG. 18 are flow charts showing calculating procedure of the appearing frequency of "Straight", FIG. 19 is an explanatory view showing the configuration and content of digital areas used for executing the calculating procedure of FIG. 18, FIG. 20 is an explanatory view showing an example of the calculation result of FIG. 18, FIG. 21 are flow charts showing the calculating procedure of the appearing frequency of "Flush", FIG. 22 is an explanatory view showing an example of the calculation result of FIG. 21, FIG. 23 are flow charts showing calculating procedures of the appearing frequencies of "Straight" and "Flush", FIGS. 24 and 25 are explanatory views showing the configuration and content of digital areas used for executing the calculating procedure of FIG. 23, FIG. 26 is an explanatory view showing an example of the calculation result of FIG. 23, and FIG. 27 are flow charts showing calculating procedure of the appearing frequency of "Royal Flush".

DETAILED DESCRIPTION

Figure 1:
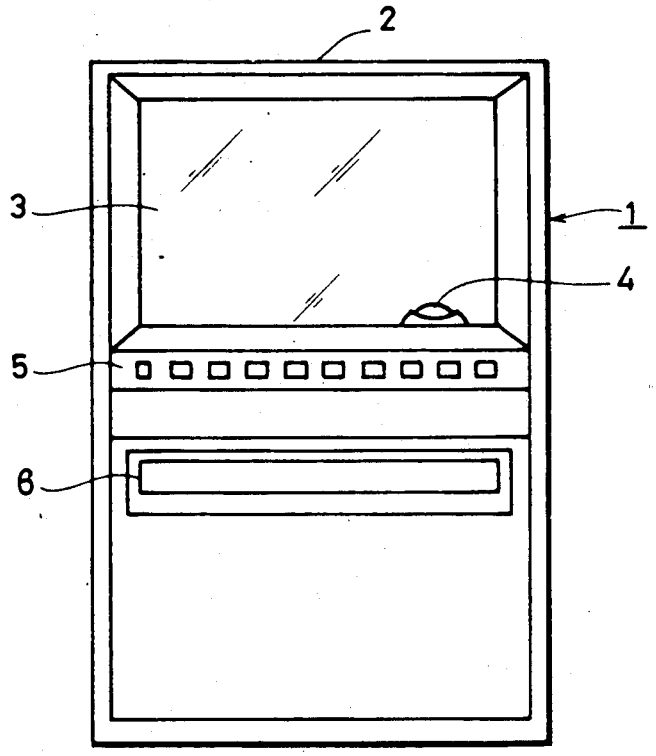
FIG. 1 is a front view of a card gaming machine according to the present invention.

Though a card gaming machine 1 for a poker game according to the present invention is shown in FIG. 1, the present invention is not limited to such gaming machine for assorting card symbols, but may be applied to the other symbol assorting gaming machine.

The card gaming machine 1 shown in the figure comprises a display 2 consisting of a CRT and installed in the upper front of a machine body 2, a coin inserting port 4, an operating panel 5 and a coin receiver 6 arranged thereunder.

Figure 2:
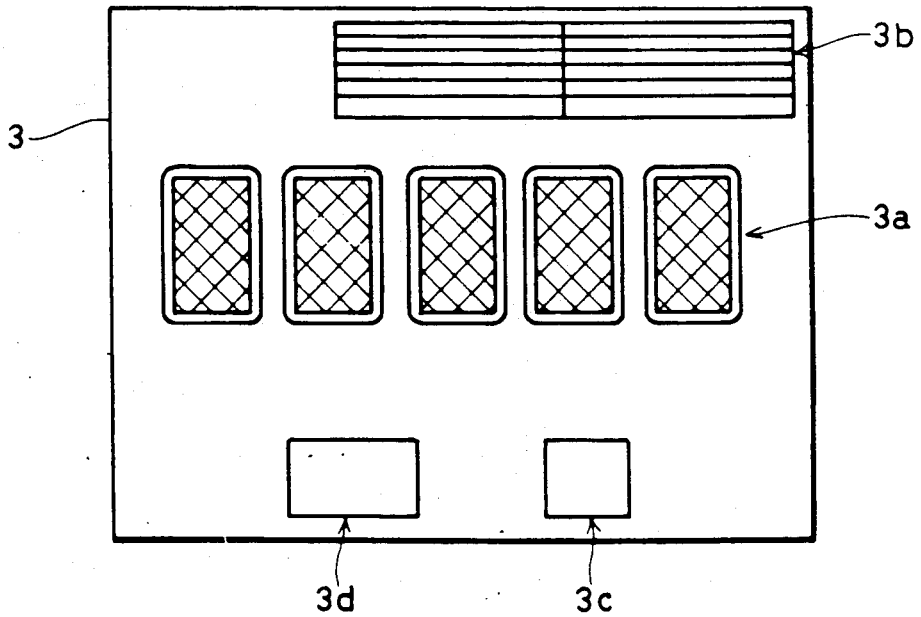
FIG. 2 is an explanatory view showing the screen configuration of a display.

FIG. 2 shows the screen configuration of the display 3, in which a card display **3*a*, an odds display 3*b*, a betting card number display 3*c* and a holding card number display 3*d*** are provided respectively in the center, upper and lower portions of the screen.

The card display **3*a*** is designed to display images of the 5 cards (hereinafter merely referred to as a "card") in a line laterally, and display a hold mark to be described later near (Right underneath) each of the cards.

The odds display **3*b* displays the kinds of winning pattern and dividend for the number of coins being bet. FIG. 3** shows a specific example of an odds table. According to the figure, a total of nine kinds of winning patterns are set as "Royal Flush" being the highest, for example, respective dividends are decided such as one "Pair", two "2 Pair" and three "3 Kind" for one coin being bet. Similarly, it has been set such that when 2 coins are bet, the dividend is twice the above and when 3 coins are bet the dividend is three times, and for the maximum allowable betting number of 5 coins, 16 times is set instead of 5 times only for "Royal Flush".

The betting number display **3*c* is designed to display the number of coins bet for each game, and the holding number display 3*d* is for displaying a total number of coins deposited to the machine by the player. Here, the coins deposited to the machine are the part of coins held by the player but inserted successively into the machine through the coin inserting port 4 and deposited therein temporarily. In the gaming machine 1, a game is played by these deposited coins and when the dividend is made, the display on the holding number display 3*d*** is adopted to be renewed to the value added by the number of dividend coins.

FIG. 4 shows the configuration of the operating panel 5, in which a total of 10 push buttons 7–16 consisting of an illuminated push-button switch are arranged in a line. The push button indicative of a character "CASH OUT" is for refunding the coins deposited. The push button 8 of "ONE BET" is for setting the number of coins to be bet one by one, in which one coin is set as the betting number when pressed once and two coins are set when pressed twice. For setting the maximum allowable number (5) as the betting number, the push button 14 of "MAX BET" may be pressed.

The push button 9–13 of "HOLD/CANCEL" are for holding one or more optional cards for 5 cards displayed on the display 3 at the beginning, whereby when pressing the left end push button 9 in the figure, a left end card is held and when the next push button 10 is pressed, a second card from the left is held respectively. Also the push button 9–13 are commonly used for releasing the hold such that, by pressing the push button corresponding to the card being held, the hold is released.

The button 15 of "DEAL/DRAW" is for proceeding with the game, when the button 15 is pressed after setting the number of coins to be bet, 5 cards are extracted optionally and displayed on the display 3, and when pressed after the holding operation, the cards other than those being held are replaced with the new cards extracted optionally and displayed.

The button 16 of "BEST BET" is for demanding the gaming machine 1 to provide holding information. The holding information is for instructing the player which is most suitable to be held out of 5 cards displayed initially to complete the winning pattern. When the button 16 is pressed, a control circuit 17 (shown in FIG. 5) incorporated in the gaming machine 1 executes the probability calculation to calculate the holding object, and the calculation result is displayed on the display 3 to instruct the player.

The coin receiver 6 in FIG. 1 is for placing the remained coins of the player or for receiving refund of the deposited to the gaming machine 1

FIG. 5 shows the entire configuration of the control circuit 17.

The control circuit 17 comprises a microcomputer in which a CPU18 is used mainly for control and calculation, a ROM 19 for storing programs and fixed data and a RAM20 as a working area. Thus, the CPU18 decodes the program of the ROM19, executing the probability calculation for calculating the holding object while writing and reading the data for the ROM19 and RAM20, and controlling the input/output operation for the operating panel 5 and a coin mechanical portion 23 via 1/0 ports 21, 22. The coin mechanical portion 23 executes the mechanical operations incidental to the reception and refund of coins.

A CRT controller 24, in response to graphic codes written in a refresh memory 25 responsive to the controlling operation of the CPU18, reads out image patterns of respective cards corresponding to the codes from a ROM26 for every line and row for data conversion into serial data. This data is sent to a video circuit 27 as the video signal, in response thereto the video circuit 27 displays a predetermined image on the display 3.

In the figure, an oscillation circuit 28 sends out a clock which decides the operation timing of the CPU18 and the CRT controller 24. A buffer 29 retains the input from the operation panel 5 and a driving circuit 31 lights lamps (not shown) incorporated in respective push buttons 7–16. Meanwhile, the driving circuit 31 drives the coin mechanical portion 23 to execute the receiving and releasing operation of the coins.

Figure 6:
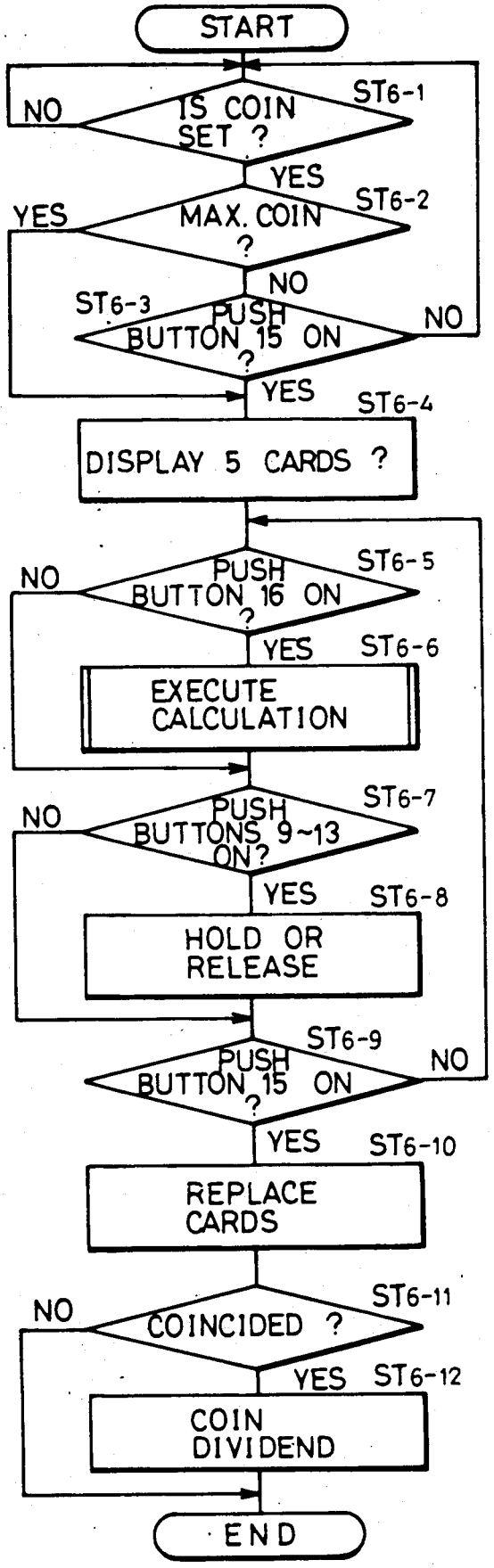
FIG. 6 is a flow chart showing the flow of the gaming operation of a card gaming machine.
Figure 7:
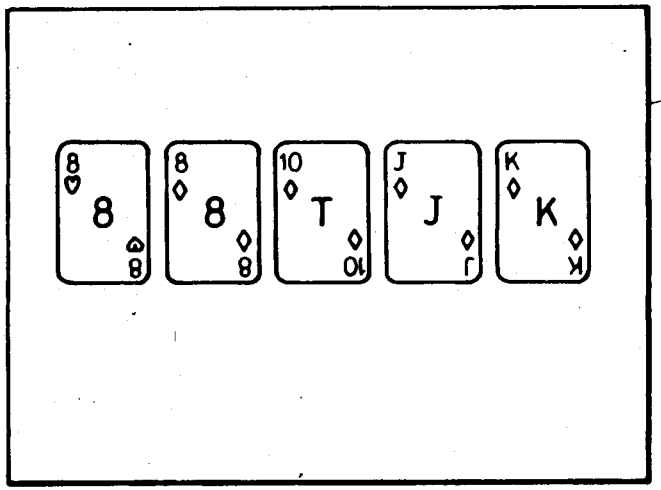
FIG. 7 is an explanatory view showing a specific example of pictures displayed initially on a display, FIG. 8 are explanatory views showing changes of pictures on a display.
Figure 8:
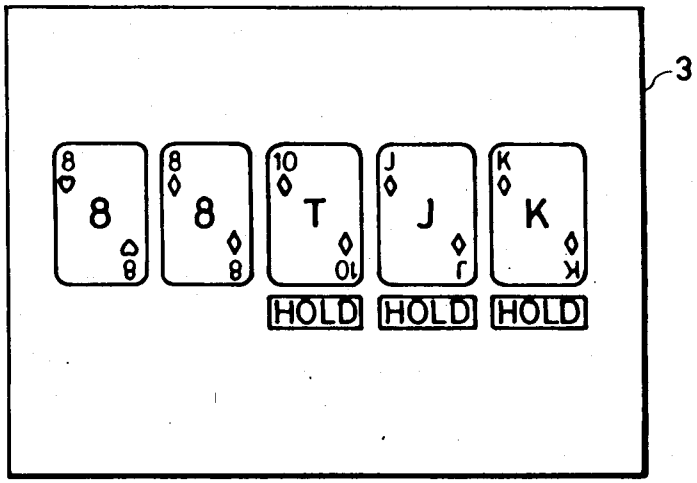
Figure 8:
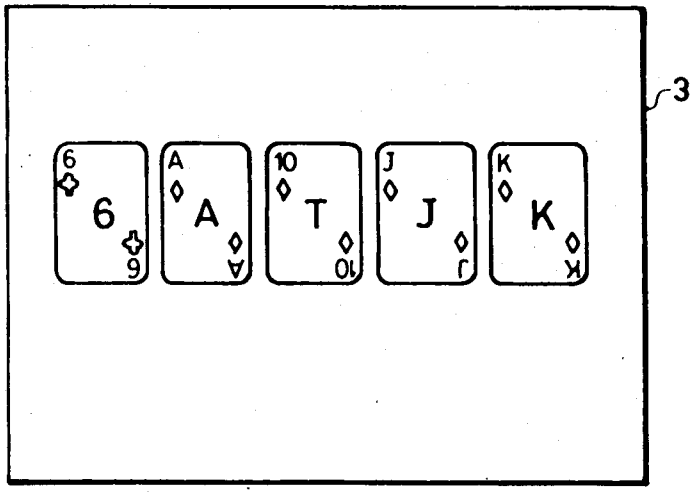
Figure 8:
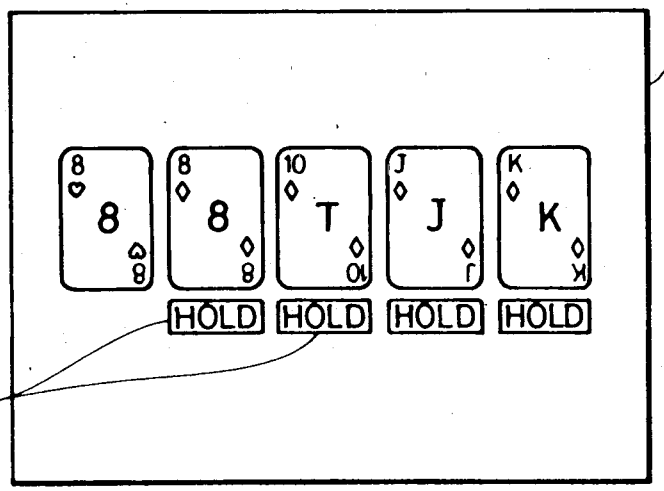

FIG. 6 shows a flow of entire gaming operation of the card gaming machine 1, and FIGS. 7 and 8 (1)–(3) show a specific example of pictures displayed initially and their changes.

When the push button 15 of "DEAL/DRAW" is pressed after setting the number of coins to be bet by pressing the push button 8 of "ONE BET" on the operating panel 5, Step 6-1 (shown in the figure as "ST 6-1") and Step 6-2 of FIG. 6 turn to "YES" and the game is initialed, extracting 5 cards optionally and displaying on the display 3 (Step 6-4). When the button 14 of "MAX BET" is pressed in place of the button 8, the maximum allowable number of 5 coins are bet and in this case, Step 602 turns to "YES" and the procedure is moved immediately to Step 6-4.

In the specific example (this example will be used repeatedly hereafter) shown in FIG. 7, respective cards of "8 of heart", "8 of diamond", "10 of diamond", "11 (Jack) of diamond" and "13 (Kind) of diamond" are displayed initially in the center of the display 3.

In the next Step 6-5, whether the button 16 of "BEST BET" is pressed is determined.

Figure 12:
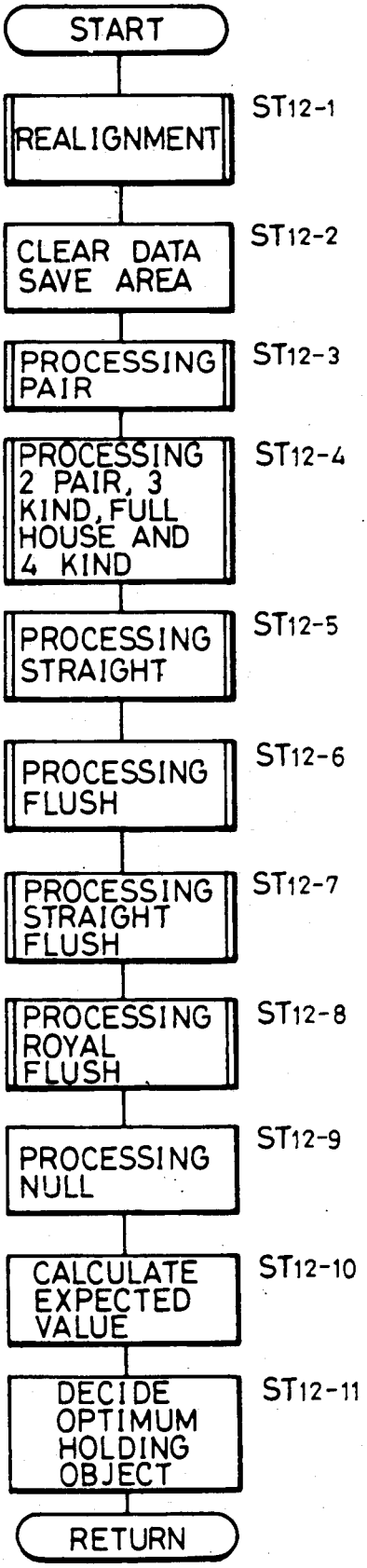
FIG. 12 is a flow chart showing calculating procedures.

When the button 16 is pressed, the procedure is advanced to Step 6—6 wherein the CPU18 starts a program shown in FIG. 12 to execute the probability calculation for calculating the optimum holding object, the calculation result thereof is displayed on the display 3 so as to instruct the player.

FIG. 8 (1) shows an example of instruction, in which "8 of diamond", "10 of diamond", "11 (Jack) of diamond" and "13 (King) of diamond" are held out of the 5 cards and holding marks 32 are indicated right under the respective cards.

If the push button 16 of "BEST BET" is not pressed, Step 6—6 is skipped and the procedure is moved to Step 6-7 from Step 6-5.

If the player follows suit with holding information provided by the machine, the push button for proceeding the game is pressed in Step 6-7, but if he does not follow suit, either of push button 9–13 of "HOLD/-CANCEL" is pressed in Step 6-7 to change the holding object (Step 6-8).

For example, under the condition of FIG. 8 (1), if the player presses the push button 10 when he wants to release holding for the card "8 of diamond", the holding is released and the holding mark 32 under the "8 of diamond" disappears (refer to FIG. 8 (2)).

If the push button 15 for proceeding the game is pressed, the card other than those being held is replaced with the other cards newly extracted optionally and displayed in the same position (Step 6-9. 6-10).

FIG. 8 (3) shows the card "8 of heart" replaced with "6 of club" and "8 of diamond" with "1 (Ace) of diamond" respectively.

As the result, in Step 6-11, whether the card combination pattern is coincided with either of the winning patterns is determined, if "YES" in Step 6-11, a dividend of coins corresponding to the kind of winning pattern is refunded to the player in Step 6-12 and the game is over, if "NO" in Step 6-11, the game ends as it is.

Figure 9:
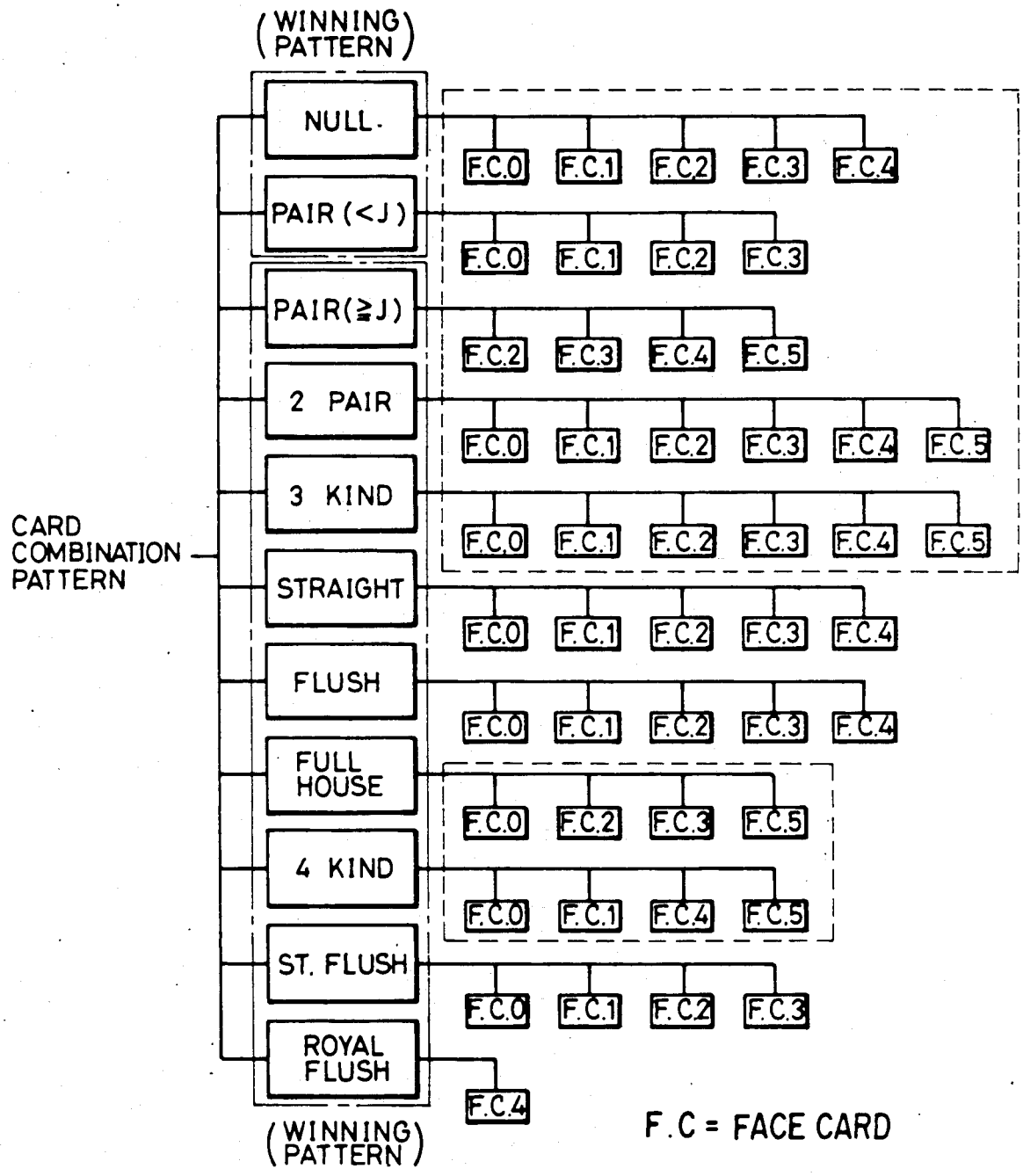
FIG. 9 is a chart illustrating the various number of face cards F.C. that are possible in each pattern of cards.
Figure 10:
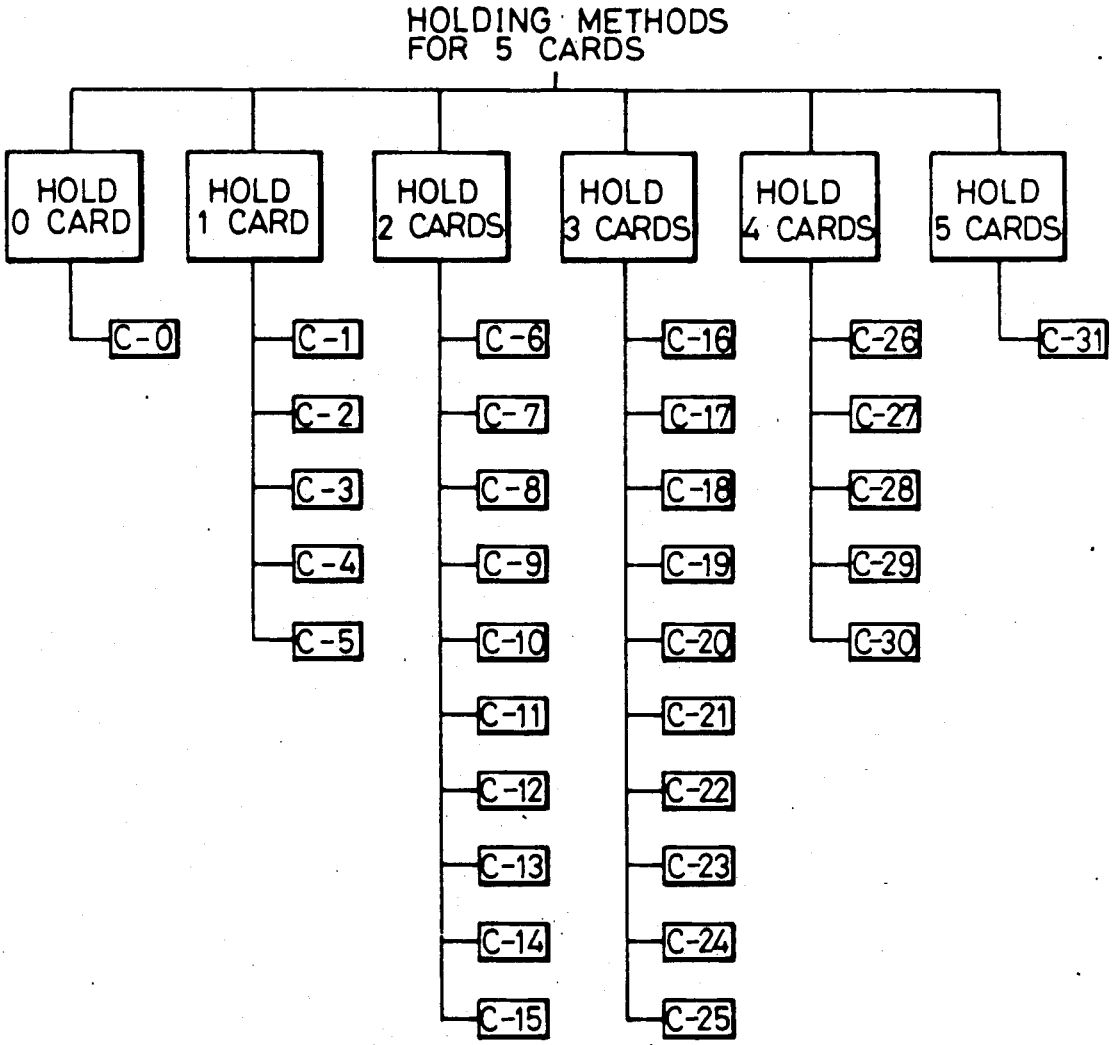
FIG. 10 is a chart identifying the calculating methods that must be considered in determining an optimum holding of cards, as a function of the number of cards that are held.

FIGS. 9 and 10 show sorting methods introduced for executing the probability calculation in a short time. In FIG. 9, the combination pattern of 5 cards displayed initially is sorted in a large scale into 9 winning patterns and 2 missing patterns, and the card configuration of respective cards is sorted in a small scale responsive to the number of face cards. Here, the face card (F.C.) stands for each of cards 11 (Jack), 12 (Queen), 13(King) and 1 (Ace). In the figure, when the number of face cards in the hand is one, it is represented as "F.C.1".

In FIG. 9, "Null" shows the losing pattern with which 5 cards are completely disassociated, in the card configuration in this card, the face card takes the form of either 0, 1, 2, 3 or 4 cards, i.e. there are up to four face cards in the hand. "Pair ( $<$J )" shows the losing pattern including a card pair of non-face cards 2–10. In the card configuration in this case, there are either 0, 1, 2 or 3 cards.

"Pair ($\geqq$J)" shows the winning pattern including a card pair of either 11 (Jack), 12 (Queen), 13 (King) or 1 (Ace). In the card configuration in this case, there are either 2, 3, 4 or 5 face cards.

The card configurations of each of the winning patterns of "2 Pair" - "Royal Flush" are as shown in FIG. 9, descriptions of which will be omitted here.

In FIG. 10, the holding method for 5 cards displayed initially is sorted into six categories, dependent on the number of cards being held, and each category is sorted into the respective number of holding modes C0–C31 that should be considered for the respective hand. FIG. 11 illustrates the possibilities for the appearance of each prize pattern, and each losing pattern, for each of the holding modes or methods C-0 to C-31.

For example, when holding one out of 5 cards of "8 of heart", "8 of diamond", "10 of diamond", "11 (Jack) of diamond" and "13 (Kind) of diamond", there are a total of 5 holding modes, the methods of holding "8 of heart", "8 of diamonds", "10 of diamond", "11 (Jack) of diamond", and "13 (King) of diamond". In FIG. 10, these are shown in respective block of C-1-C-5, the number of modes can be represented by "$5C_1$" mathematically and the number of patterns of the card combination pattern obtained therefrom becomes "${}_{47}C_4$".

Similarly, these are the modes "${}_5C_0=1$" for holding 0 card out of 5 cards, "${}_5C_2=10$" for holding 2 cards, "${}_5C_3=10$" for holding 3 cards, "${}_5C_4=5$" for holding 4 cards and "${}_5C_5=1$ for holding 5 cards, thus the total number of holding modes become 32 modes (C-0-C-31).

The card combination pattern produced as the result of replacing the card other than those being held with the other cards is either of 9 kinds (winning patterns) of "Royal Flush"—"Pair" or the other patterns, so that the possibility of appearance of each of the winning patterns is calculated for each holding mode from the number of patterns (Hereinafter referred to as an appearing frequency), and the holding made of the highest expected value, to be described later, among which is selected to instruct the optimum holding object to the player.

Thus, though the appearing frequency must be calculated for $32\times10=320$ winning and losing combinations, in the case of this embodiment, a specific winning pattern is obtained from fixed data obtained by the precalculation, and the remaining patterns are calculated by executing calculating procedures in response to an individual algorithm. That is, for "Pair" of the winning patterns a reference is made to a first group table and for "2 Pair", "3 Kind", "Full House" and "4 Kind" a reference is made to a second group table to calculate the appearing frequency respectively. Moreover, the appearing frequency is calculated by calculating in response to the algorithm of FIGS. 18 (1)-(8) for "Straight", the algorithm of FIGS. 21 (1)-(7) for "Flush" , the algorithm of FIGS. 23 (1)-(7) for "Straight Flush" and the algorithm of FIGS. 27 (1)-(7) for "Royal Flush". As shown in FIG. 11, these 320 data are stored in the data save area provided in the RAM20.

FIG. 12 shows calculating procedures of the holding object in response to the aforesaid calculation by the CPU18.

When the push button 16 of "BEST BET" is pressed after 5 cards are displayed initially on the display 3, first in Step 12-1 FIG. 12, the configuration of 5 cards is realigned respectively in a constant direction in numerical order or in order of heart, diamond, club and spade, and further the pair in the first if any, and from the younger number in the case of two pairs.

Then, after clearing the data save area in Step 12-2, the appearing frequency of respective winning patterns for each holding mode is calculated in Step 12-3-12-8 Furthermore, in the next Step 12-9, the appearing frequency of "Null" is calculated for each holding mold by subtracting a sum of appearing frequencies of respective winning patterns, from the number of patterns (for example, ${}_{47}C_4$ for the holding mode of one card) of the card combination pattern.

In next Step 12-10, the expected value S is calculated for each holding mode from the appearing frequency and dividend rate of respective winning pattern. For example, when the appearing frequencies of nine winning patterns are $a_1$-$a_9$ and the appearing frequency of the losing pattern is b, if 1-4 coins are to be bet, the dividend rates are, as shown in FIG. 3, 1, 2, 3, 4, 5, 8, 25, 50, 250 from "Pair" to "Royal Flush" when "Pair" is 1, so that the expected value S can be obtained from the full owing equation (1).

$$S=\frac{a_1\times1+a_2\times2+\ldots a_9\times250}{a_1+a_2+\ldots a_9+b} \quad (1)$$

If the number of coins to be bet are 5, s the divided rate of "Royal Flush" is 800, the expected value S is calculated by the equation 2 in lieu of the equation (1).

$$S=\frac{a_1\times1+a_2\times2\ldots a_9\times800}{a_1+a_2+\ldots+a_9+b} \quad (2)$$

Thus, in Step 12-11, the holding mode having the highest expected value S is selected to obtain the optimum holding object.

Figure 13:
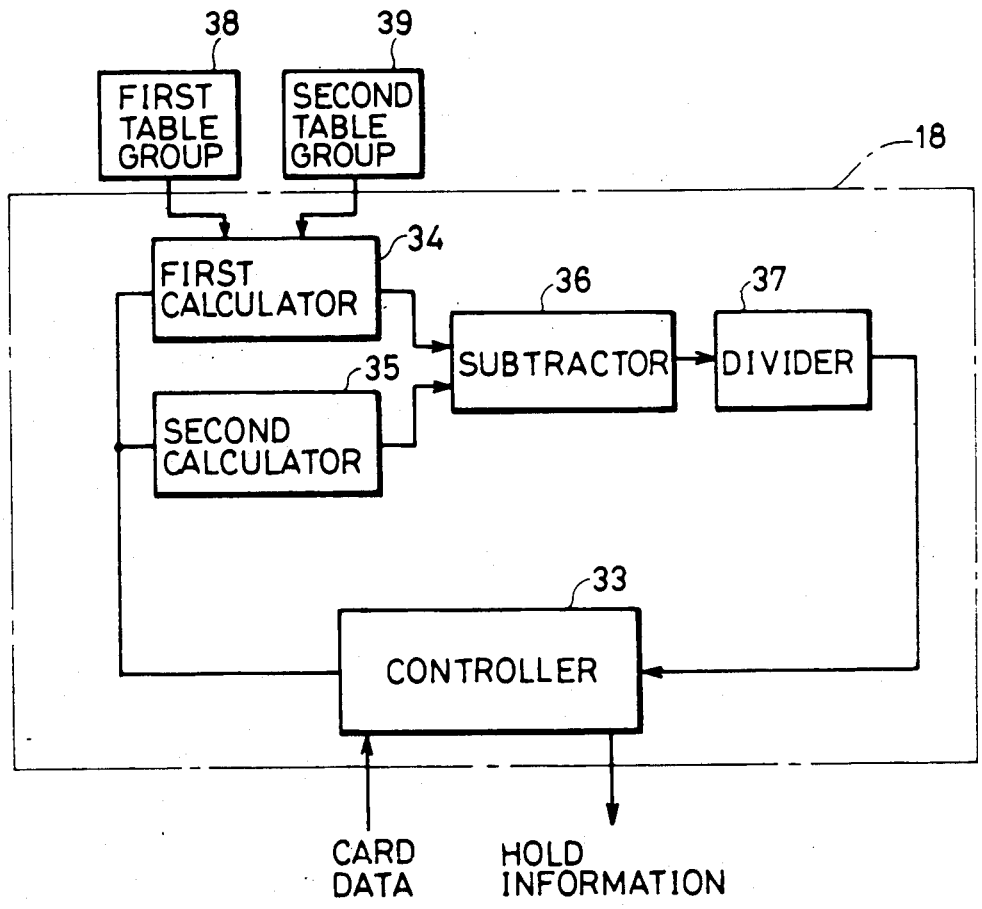
FIG. 13 is a functional block diagram showing the calculating function of a CPU.

FIG. 13 shows a block diagram in which various functions of the CPU18 are illustrated.

In the figure, a first calculator 34 calculates respective appearing frequencies of "Pair", "2 Pair", "3 Kind", "Full House", and "4 Kind" for each holding mode by referring to the first and second group tables 3, 39, and a second calculator 35 calculates respective appearing frequencies of "Straight", "Flush", "Straight Flush" and "Royal Flush" for each holding mode by executing calculating procedures in response to a predetermined algorithm. A subtracter 36 calculates the appearing frequency of "Null" by subtraction, and a divider 37 calculates the expected value S by calculating the equations 1 and 2. A controller 33 realigns the cards and selects the holding mode having the highest expected value.

Figure 14:
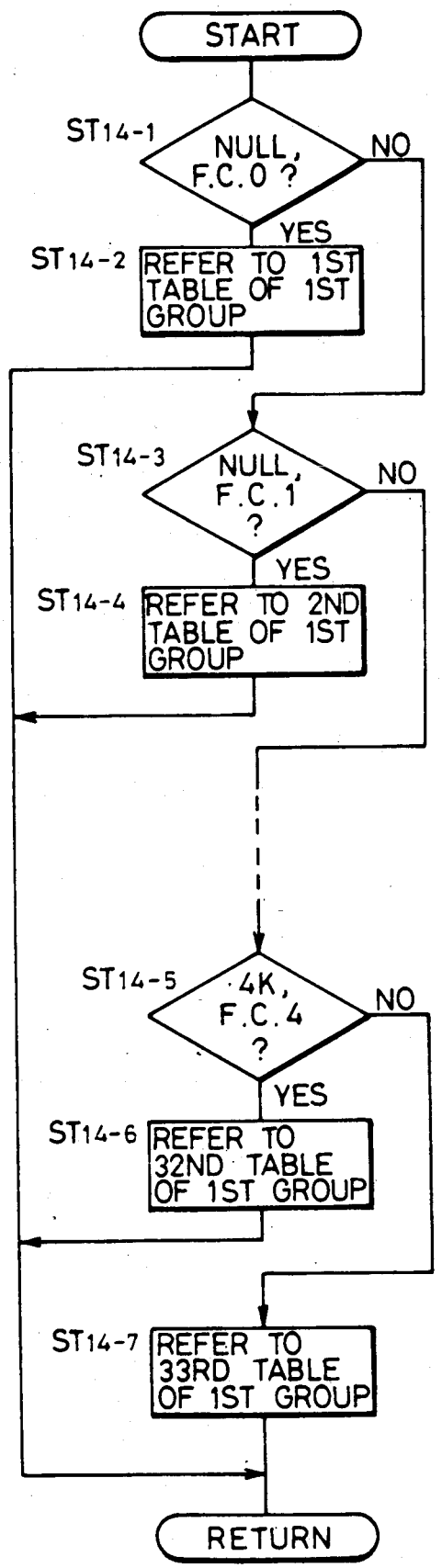
FIG. 14 is a flow chart showing calculating procedures of the appearing frequency of "Pair"

FIG. 14 shows the detail of Step 12-3 in FIG. 12 or the calculating procedure of the appearing frequency of "Pair" for each holding mode.

In Step 14-1 of FIG. 14, whether the combination pattern of 5 cards after realignment corresponds to "F.C.0" (no face card) of "Null" among the blocks sorted in FIG. 9 is determined, if "YES", the procedure is advanced to Step 14-2, wherein by referring to the first table of the first group, the appearing frequencies (fixed data) of "Pair" for all holding modes are read out and set in the data save area (refer to FIG. 11).

FIG. 15 shows the configuration of table TB1 which belongs to the first group (these are 33 tables), and the appearing frequencies for all holding modes C-0-C-31 are set in the form of fixed data.

If it is determined "NO" in Step 14-1, the procedure is then advanced to Step 14-3, wherein it is determined whether the combination pattern of 5 cards corresponds to "F.C.1" (a face card" of "Null". If "YES", the procedure advances to Step 14-4, wherein by referring to the second table of first group, the appearing frequencies of "Pair" for all holding modes are read out and set in the data save area.

Similarly, whether the combination pattern of 5 cards after realignment corresponds to either of 33 blocks shown by broken lines in FIG. 9 is determined, and responsive to the result determined, the appearing frequencies of "Pair" for all holding modes are read out by referring to either of the 33 tables of the first group and set in the data save area.

In FIG. 9, respective blocks such as "Straight" outside the broken lines can be treated as same as "Null" when viewing from the standpoint of "Pair", so that it is out of the object to be judged.

In FIG. 14, though only the first, second and 32nd judgements and corresponding processings thereof are shown, the third to 31st judgements and corresponding processings thereof are similar, so their descriptions will be omitted.

Figure 16:
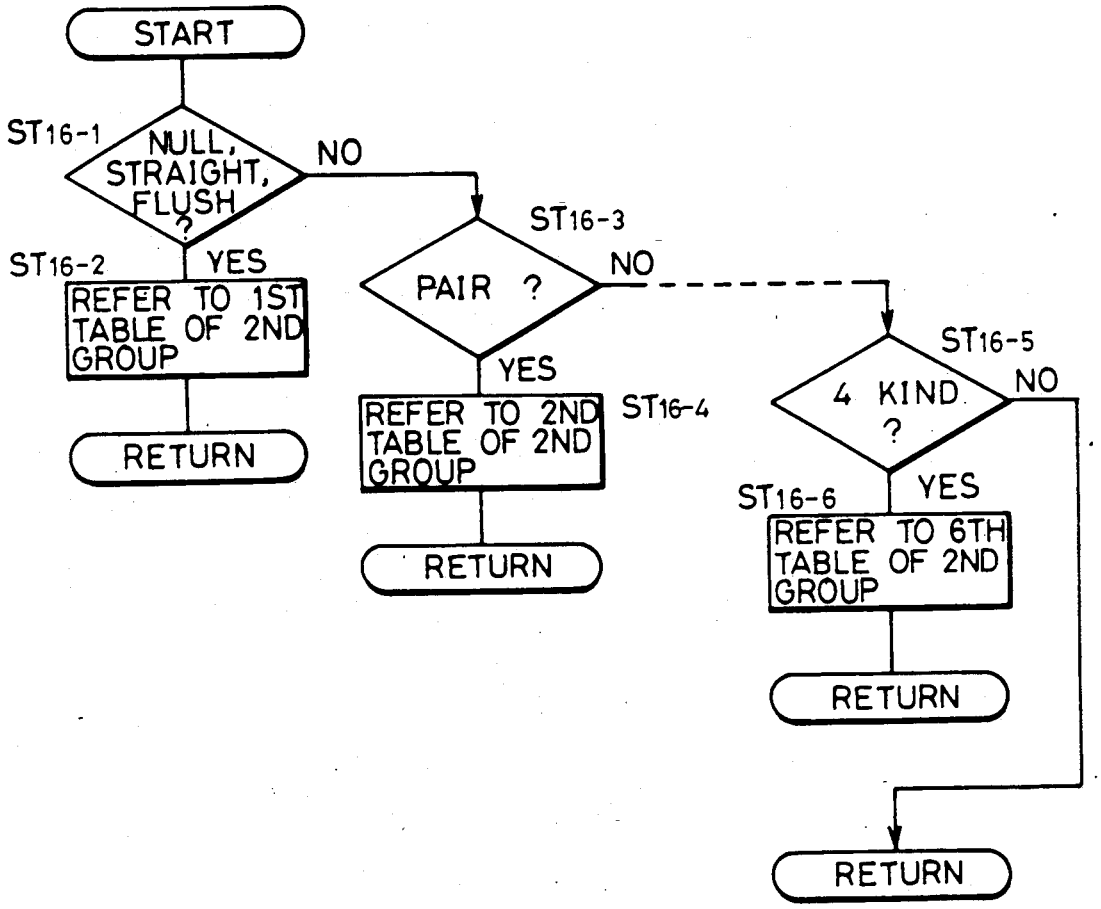
FIG. 16 is a flow chart showing calculating procedures of respective appearing frequencies of "2 Pair", "3 Kind", "Full House" and "4 kind"

FIG. 16 shows the detail of Step 12-4 in FIG. 12, or calculating procedures of respective appearing frequencies of "2 Pair", "3 Kind", "Full House" and "4 Kind" for each holding mode.

In Step 16-1 of FIG. 16, whether the combination pattern of 5 cards after realignment corresponds to either of "Null", "Straight" or "Flush" among the blocks sorted in FIG. 9 is determined, if "YES", the procedure is advanced to Step 16-2, whether by referring to the first table of the second group, the appearing frequencies (fixed data) of "2 Pair", "3 Kind", "Full House" and "4 Kind" for all holding modes are read out and set in the data save area (refer to FIG. 11).

FIG. 17 shows the configuration of table TB2 which belongs to the second group, in which respective appearing frequencies of "2 Pair", "3 Kind", "Full House" and "4 Kind" for all holding modes C-0–C-31 are set in the form of fixed data.

If it is determined "NO" in Step 16-1, the procedure is advanced to Step 16-3, then whether the combination pattern of 5 cards corresponds to "Pair" is determined. If "YES", the procedure advances to Step 16-4 and by refering to the second table of the second group, respective appearing frequencies of "2 Pair", "3 Kind", "Full House" and "4 Kind" are read out and set in the data save area.

In such a manner, it is determined whether the combination pattern of 5 cards after alignment is "Null", "Straight" and "Flush" or "Pair" or "2 Pair" or "3 Kind" or "Full House" or 4 Kind", and responsive to the result judged, and by referring to either of 6 tables of the second group, respective appearing frequencies of "2 Pair", "3 Kind", "Full House" and "4 Kind" for all holding modes are read out and set in the data saving area.

Though FIG. 16 shows only the first, second and sixth judgements and corresponding processings thereof, the third to fifth judgements and their corresponding processings are similar so the description will be omitted.

Figure 18:
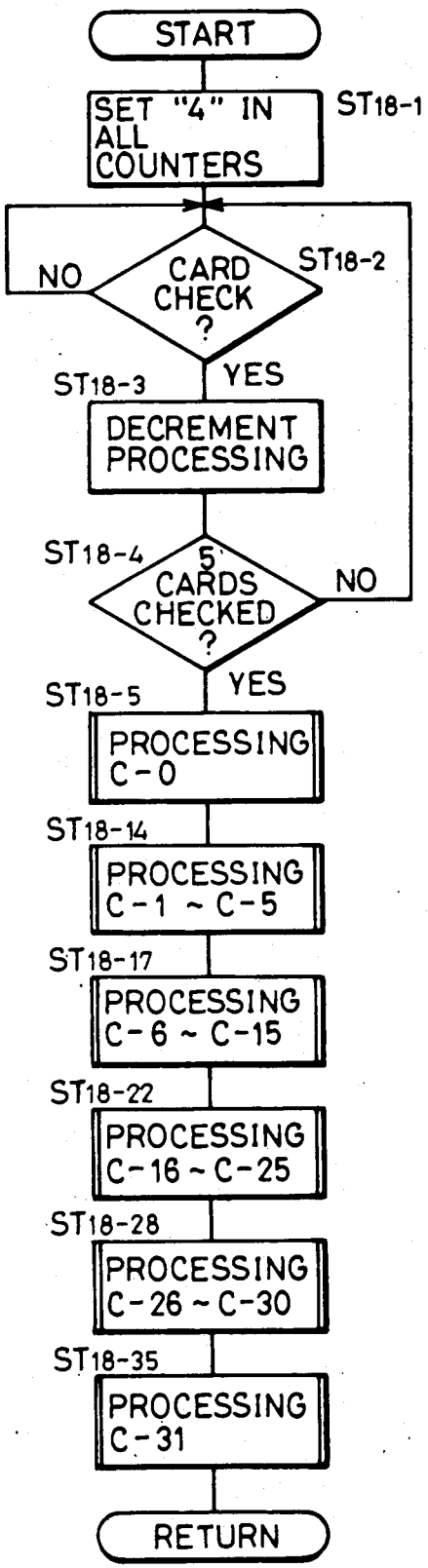
Figure 18:
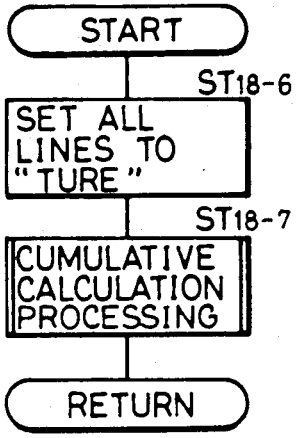
Figure 18:
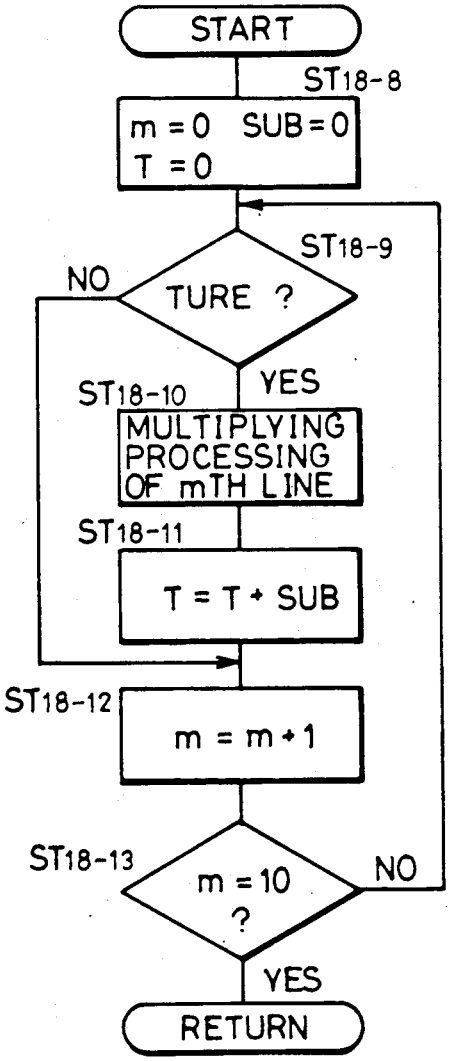
Figure 18:
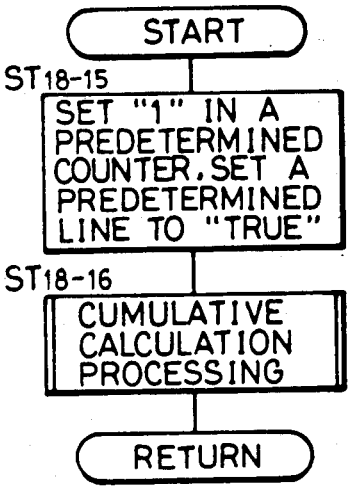
Figure 18:
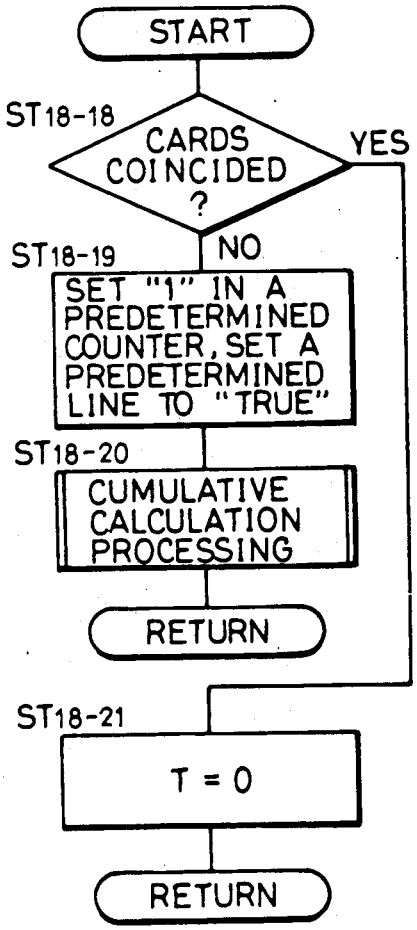
Figure 18:
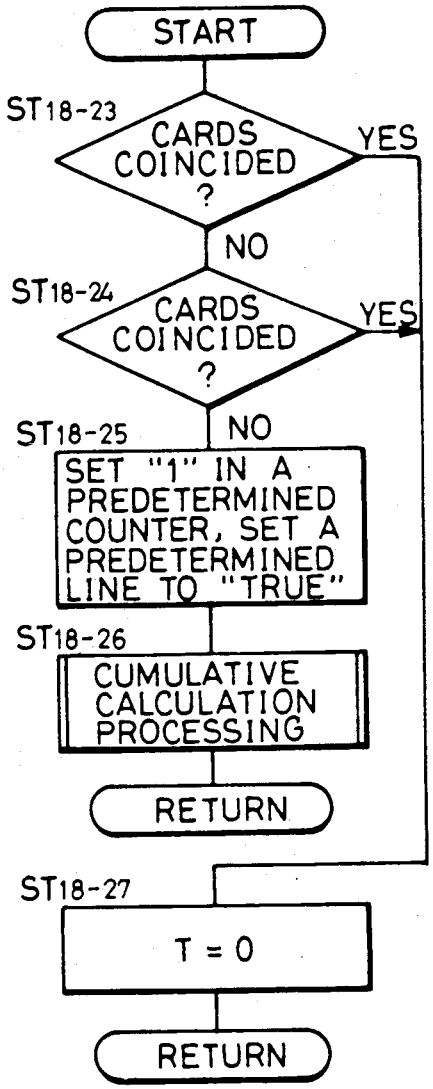
Figure 18:
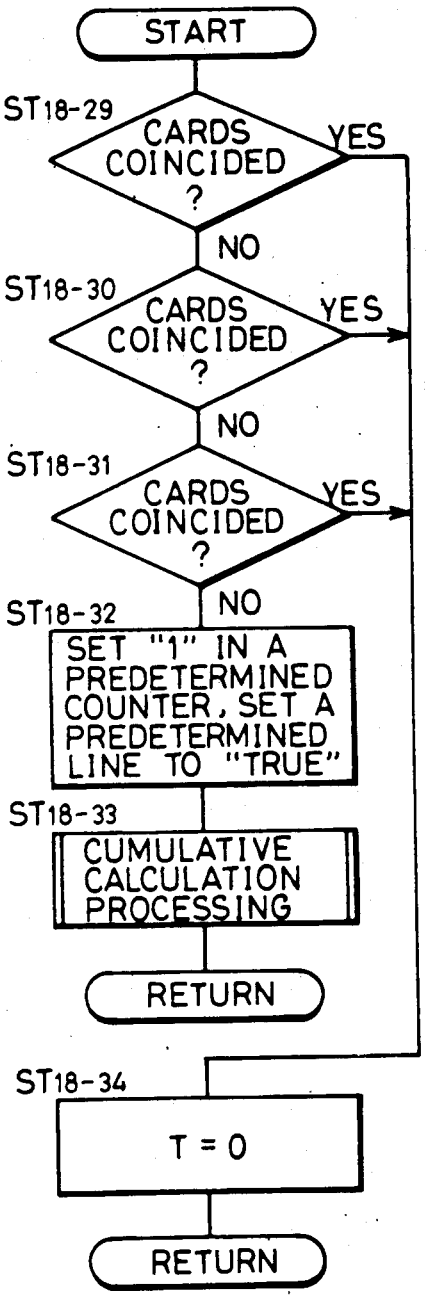
Figure 18:
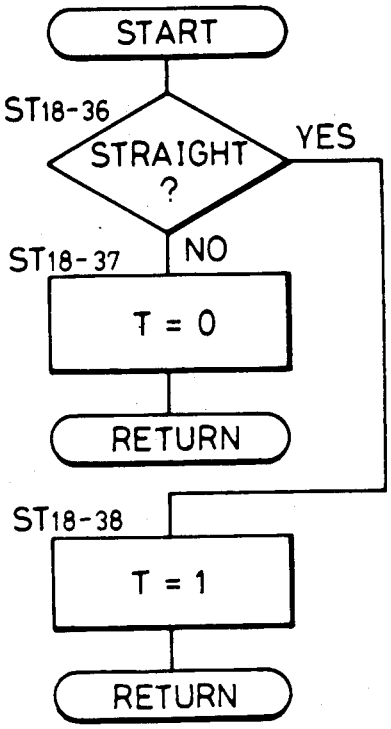

FIGS. 18 (1)–(8) show details of Step 12-5 in FIG. 12 or calculating procedures of the appearing frequency of "Straight" for each holding mold, and FIG. 19 (1) shows a digital area in the RAM20 used for executing the calculating procedure.

The digital area is divided into 10 lines ×5 rows to provide a total of 50 straight counters $CT_{ST}$. Each of the counters $CT_{ST}$ is corresponded to each numerical value (hereinafter referred to as "Rank") of Ace-King in respective cards, and in Step 18-1 of FIG. 18 (1), contents of all counters $CT_{ST}$ are set to an initial value "4" (refer to FIG. 19).

In the next Step 18-2, the rank of the first card is checked and in the following Step 8-3, the content of the counter $CT_{ST}$ corresponding to the rank is decremented. When repeating the same processing for 5 cards, the content of each counter $CT_{ST}$ corresponding to each rank of 5 cards becomes smaller than the initial value "4" as shown in FIG. 19 (2). FIG. 19 (2) shows a specific example of the case where 5 cards are "8 of diamond", "10 of diamond", "11 (Jack) of diamond" and "13 (Kind) of diamond"

If the result is "YES" in Step 18-4, in next Step 18-5, the calculating procedure (shown in FIG. 18 (2)) of the appearing frequency of "Straight" for the holding mode of C-0 are executed first.

In Step 18-6 of FIG. 18 (2), the counter $CT_{ST}$ of all lines for the digital area shown in FIG. 19 (1) is set in the "True" condition. More specifically, a flag area of 10 lines ×rows is set in the RAM20 and a flag "1" is set in the flag area of all lines.

Then, the procedure is advanced to cumulative calculation processings in Step 18-7, and the procedure of FIG. 18 (3) is executed to calculated the appearing frequency of "Straight" for the holding mode of C-0.

First, in Step 18-8 of FIG. 18 (3), the CPU18 sets zero in a line counter m therein, and after clearing the working area in the RAM20 storing the calculation value T and intermediate value SUB, determines in the next Step 18-9 whether the old counter $CT_{ST}$ is in the "True" condition. In this case, since it is "YES" in Step 18-9, the contents of respective counters $CT_{ST}$ of 0th line are multiplied to obtain the inter mediate value SUB in Step 18-10, and its cumulation is held in Step 18-11 as the calculation value T. For example, in an example shown in FIG. 19 (2), the intermediate value SUB and calculation value T of 0th line are $4\times4\times4\times4\times4=1024$.

In the next Step 18-12, the line counter m is incremented and the same processing is executed for the first line counter $CT_{ST}$ In the example shown in FIG. 19 (2), the intermediate value SUB of the first line is also $4\times4\times4\times4\times4=1024$ and the calculation value T which is its cumulative value is 2048.

The same processings are repeated until the content of the line counter m reaches 10 (Step 18-13), thereby the appearing frequency of "Straight" for the holding mode of C-0 is obtained from the cumulative result.

Then, in Step 18-14, the calculating procedure of the appearing frequency of "Straight" for the holding modes of C-1–C-5 shown in FIG. 18 (4) are executed.

In Step 18-15 of FIG. 18 (4), the content of the counter $CT_{ST}$ corresponding to the rank of the card held is set to "1", and all counters $CT_{ST}$ of the line including the counter $CT_{ST}$ are set in the "True" condition. For example, if the rank of the card held is "8", contents of respective counter $CT_{ST}$ becomes as shown in FIG. 19 (3). In the figure, the blank counters $CT_{ST}$ are not set in the "True" condition.

Next, in Step 18-16, though the cumulative calculation of FIG. 18 (3) is processed, since the procedures are same as aforementioned, its description will be omitted Then, the calculating procedures of the appearing frequency of "Straight" are executed similarly respectively for the holding modes of C-6–C-15 in Step 18-17 as shown particularly in FIG. 18 (5), for the holding modes of C-16–C-25 in Step 18-22 as shown particularly in FIG. 18 (6), for the holding modes C-26–C-30 in Step 18-28 as shown particularly in FIG. 18 (7) and for the holding mode of C-31 in Step 18-35 as shown particularly in FIG. 18 (8).

In these respective procedures, when ranks of two or more cards held are coincided, since there is no more chance for "Straight" to appear, the appearing frequency is zero. It is determined such that in Step 18-18 of FIG. 18 (5), 2 cards are coincided, in Steps 18-23 and 18-24 of FIG. 18 (6), 2-3 cards are coincided and in Steps 18-29, 18-30 and 18-31 of FIG. 18 (7), 2-4 cards are coincided, thus the calculation value T (appearing frequency) is zero (Steps 18-21, 18-27, 18-34).

When 5 cards are held, whether the card combination pattern constitutes "Straight" may be determined to set the appearing frequency to zero or 1 as shown in FIG. 18 (8).

In FIG. 20, the calculation result of the case where 5 cards are "8 of heart", "8 of diamond", "10 of diamond", "11 (Jack) of diamond" and "13 (King) of diamond" is shown.

Figure 21:
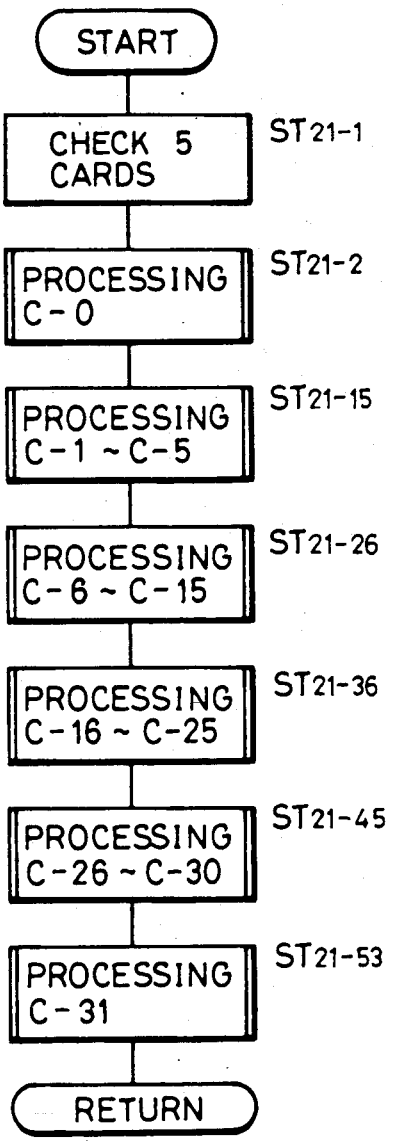
Figure 21:
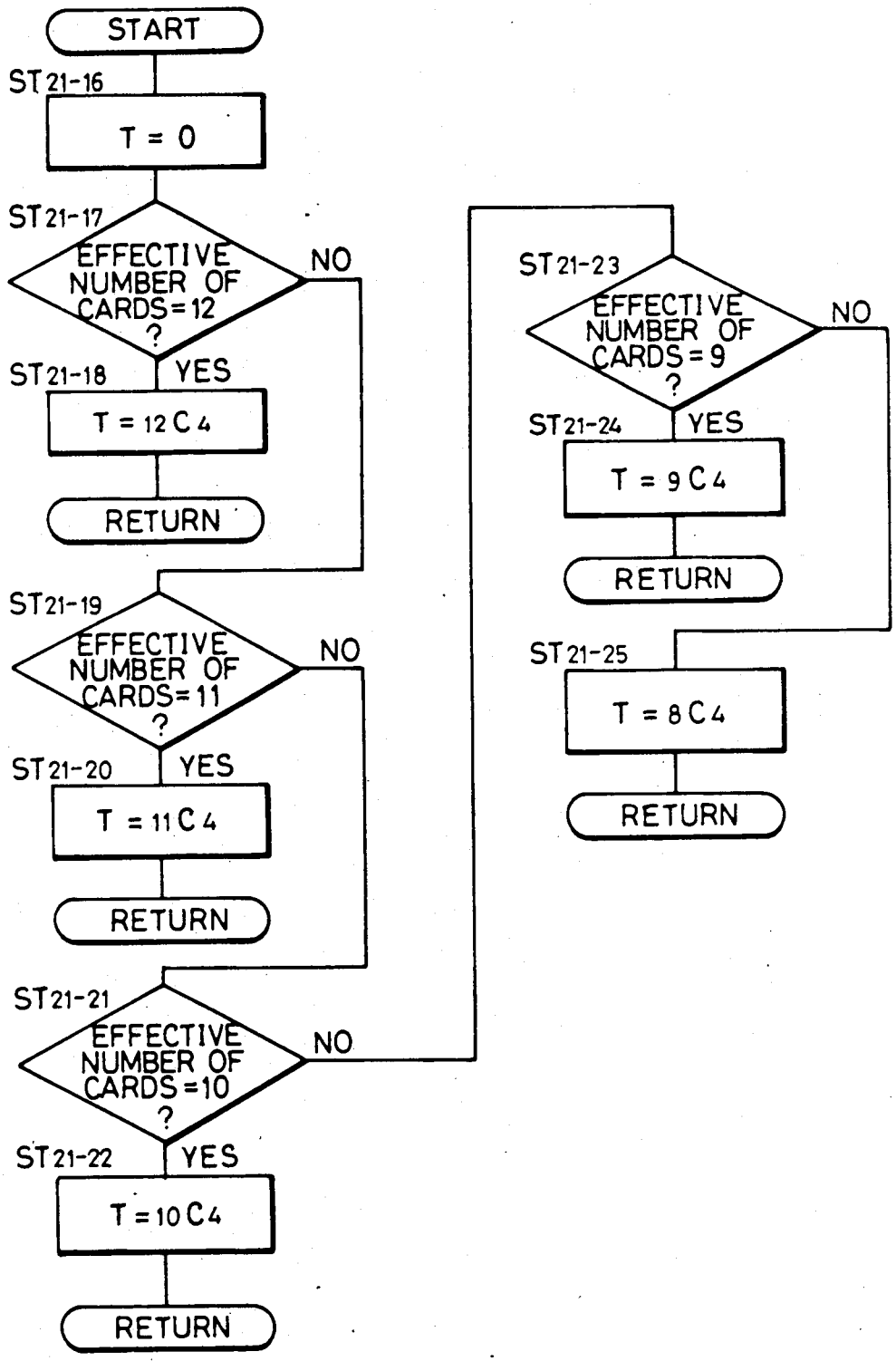
Figure 21:
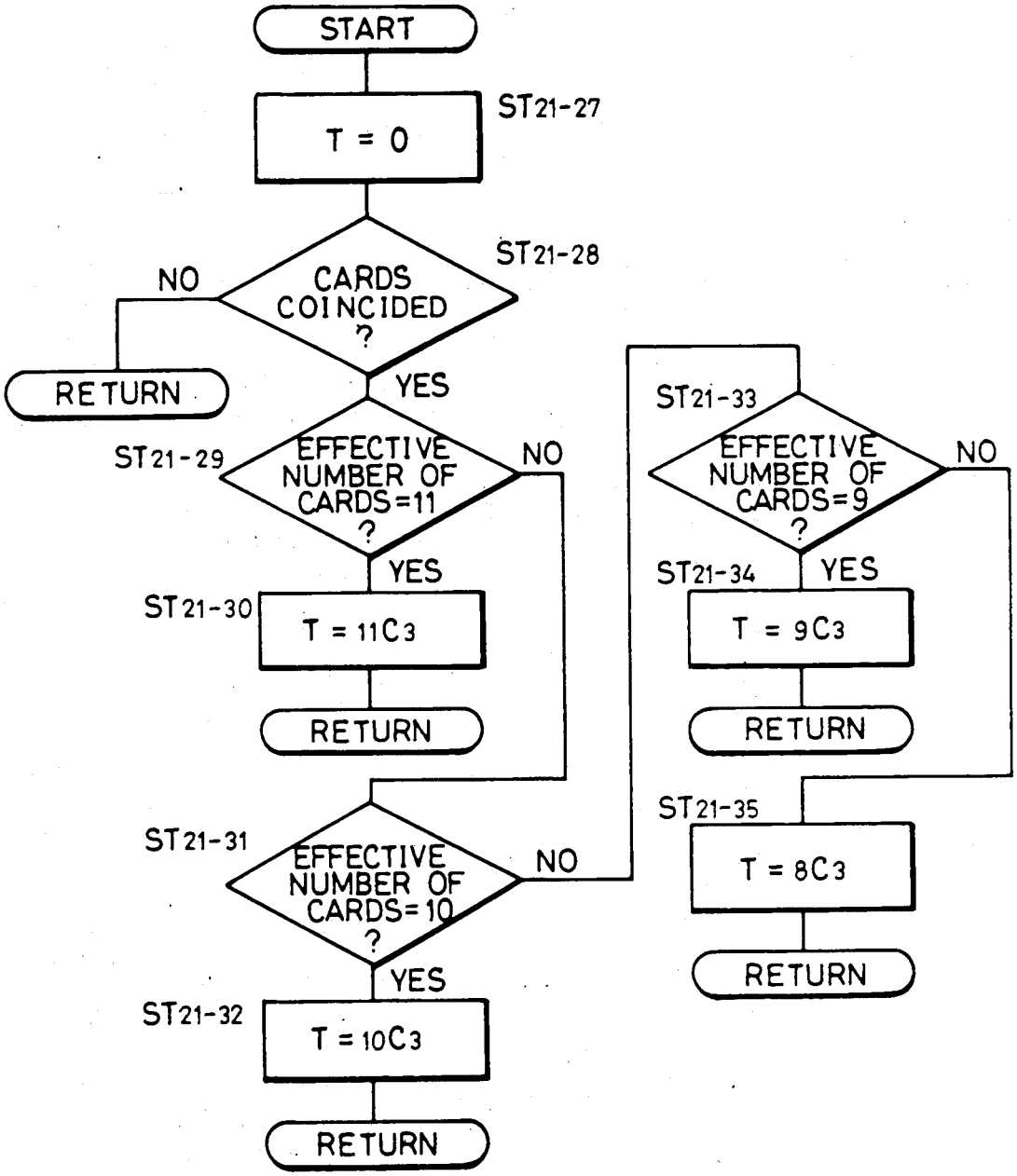
Figure 21:
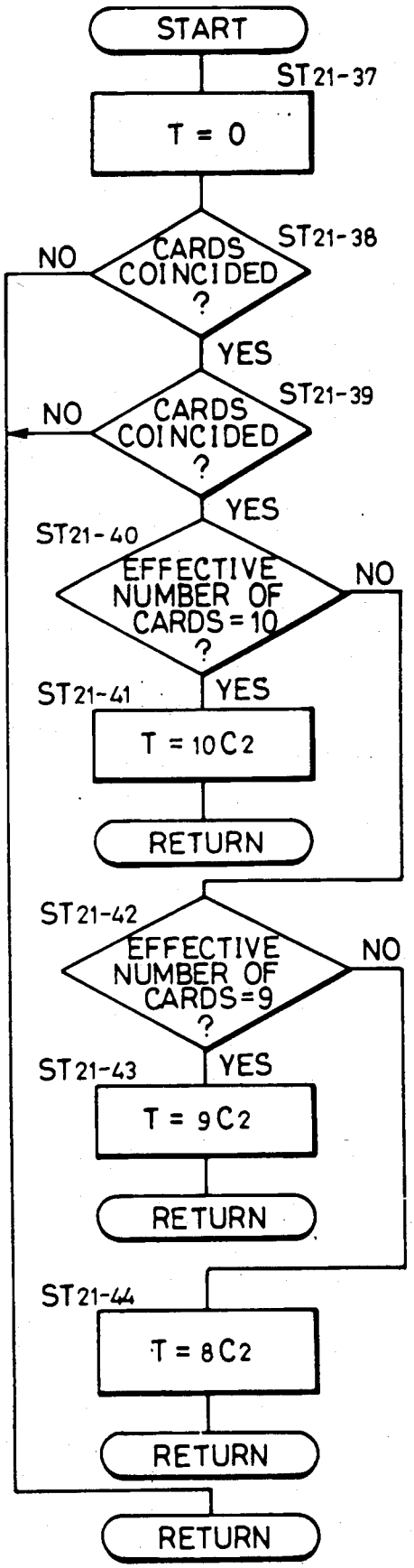
Figure 21:
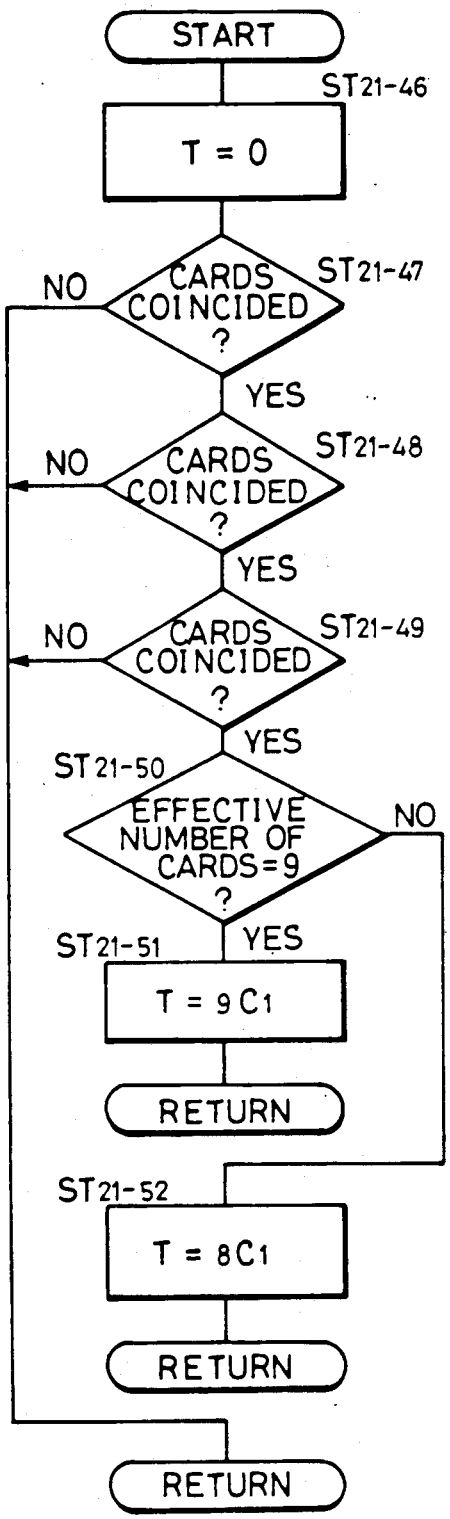
Figure 21:
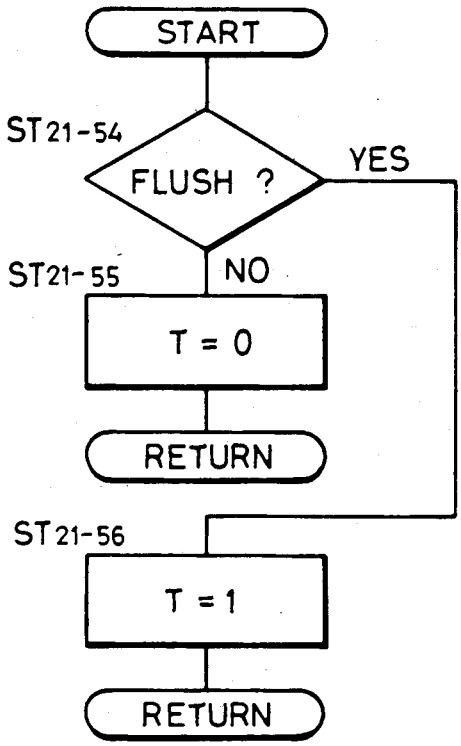

FIG. 21 (1)-(7) show the detail of Step 12-6 in FIG. 12, or the calculating procedure of the appearing frequency of "Flush" for respective holding molds.

Now, though "Flush" is constituted by combination of cards of the same kind, when the combination patterns of 5 cards are sorted by the kinds of card and assuming that their numbers are larger in order of heart, diamond, club and spade, it can be sorted into the following 6 types.

| | Heart | Diamond | Club | Spade |
|---|---|---|---|---|
| Type 1 | 5 | 0 | 0 | 0 |
| Type 2 | 4 | 1 | 0 | 0 |
| Type 3 | 3 | 2 | 0 | 0 |
| Type 4 | 3 | 1 | 1 | 0 |
| Type 5 | 2 | 2 | 1 | 0 |
| Type 6 | 2 | 1 | 1 | 1 |

When 13 cards are left for one kind of card (effective number of cards is 13), the appearing frequencies of "Flush" are ${}_{13}C_5$ (=1287). Similarly, if the effective number of cards is 12 the appearing frequencies are ${}_{12}C_5$ (=792), if 11 the appearing frequencies are ${}_{10}C_5$ (=252), if 9 the appearing frequencies are ${}_{9}C_5$ (=126) and if 9 the appearing frequencies are ${}_{8}C_5$ (=56). These values are precalculated and retained as fixed data.

First, in Step 21-1 of FIG. 21 (1), 5 cards are checked and in the next Step 21-2, the calculating procedure as shown in FIG. 21 (2) of the appearing frequency of "Flush" for the holding mode of C-0 is executed.

In Step 21-3 of FIG. 21 (2), the working area in the RAM20 storing the calculation value T is cleared and in the following Step 21-4, whether the combination pattern of 5 cards belongs to the type 1 aforementioned is determined.

If it belongs to type 1 ("YES" in Step 21-4), since the cards of one kind are 5, when the holding number of card is zero, the effective number of that type of cards is 13-5-8 and the appearing frequency of "Flush" is ${}_{8}C_5$. Since the effective number of cards of the other type cards are all 13., the appearing frequencies of "Flush" are ${}_{13}C_5 \times 13$, and its sum (${}_{8}C_5 + {}_{13}C_5 \times 3$) is the required value T (Step 21-5).

Similarly, in Steps 21-6, 21-8, 21-10 and 21-12, types 2-6 are determined and responsive to the determined result, the appearing frequencies of "Flush" are calculated (Steps 21-7, 21-9, 21-11, 21-13 and 21-14).

Next, in Step 21-15, the calculating procedure (shown in FIG. 21 (3)) of the appearing frequencies of "Flush" for the holding modes of C-1-C-5 is executed.

In Step 21-16 of FIG. 21 (3), first the working area storing the calculation value T is cleared, and in Steps 21-17, 21-19, 21-21 and 21-23, the number of effective cards remained when a certain kind of card is held is determined to calculate the appearing frequency of "Flush" responsive to the determined result "Step 21-18, 21-20, 21-22, 21-24 and 21-25.)

Then, the calculating procedures of the appearing frequencies of "Flush" are executed similarly respectively for the holding nodes of C-6 C-15 in Step 21-26 as shown particularly in FIG. 21 (4), for the holding modes of C-16-C-25 in Step 21-36 as shown particularly in FIG. 21 (5), for the holding modes C-26-C-30 in Step 21-45 as shown particularly in FIG. 21 (6) and for the holding mode of C-31 in Step 21-53 as shown particularly in FIG. 21 (7).

In these respective procedures, when kinds of two or more cards held are not coincided, since there is no more chance for "Flush" to appear, the appearing frequency is zero. It is determined such that in Step 21-28 of FIG. 21 (4), the kinds of 2 cards are coincided, in Steps 21-38 and 21-39 of FIG. 21 (5), the kinds of 2-3 cards are coincided and in Steps 21-47, 21-48 and 21-49 of FIG. 21 (6), the kinds of 2-4 cards are coincided, if it is determined that they do not coincide, the calculation value T is kept zero and data are not renewed.

When the 5 cards are held, whether the combination pattern of the cards constitutes "Flush" may be determined to set the appearing frequency to zero or 1 as shown in FIG. 21 (7).

FIG. 22 shows the calculation result aforementioned when the 5 cards are "8 of heart", "8 of diamond", "10 of diamond", "11 (Jack) of diamond" and "13 (King) of diamond"

Figure 23:
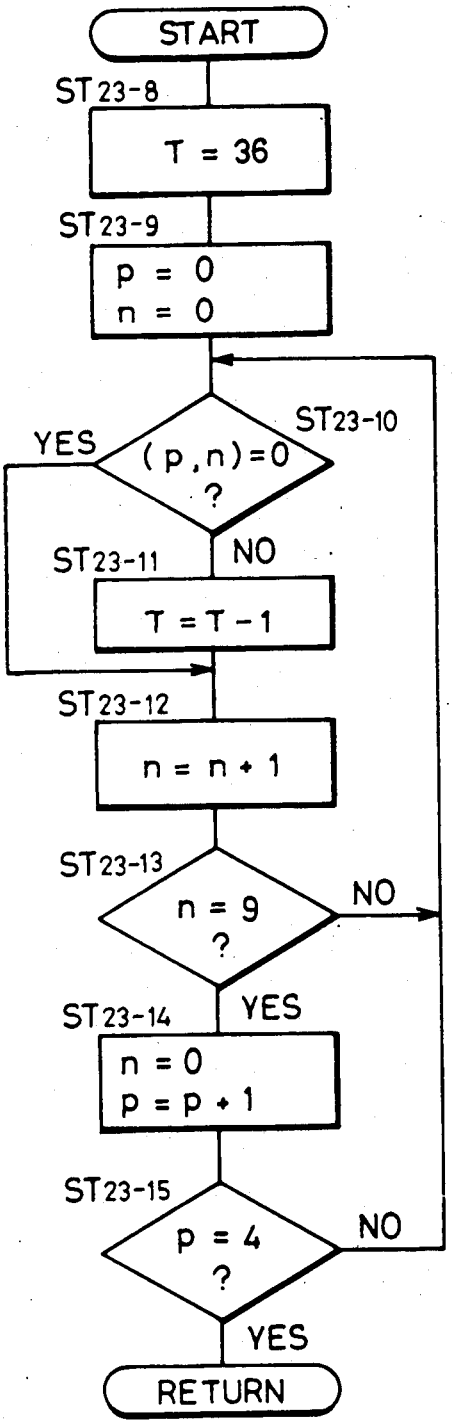
Figure 23:
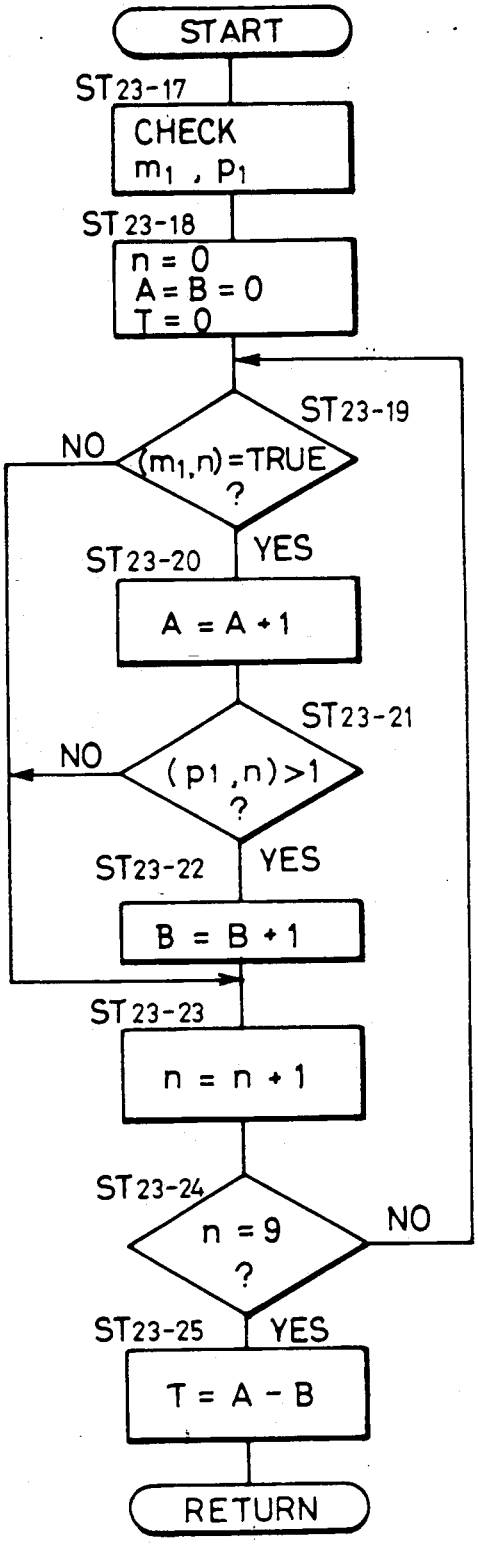
Figure 23:
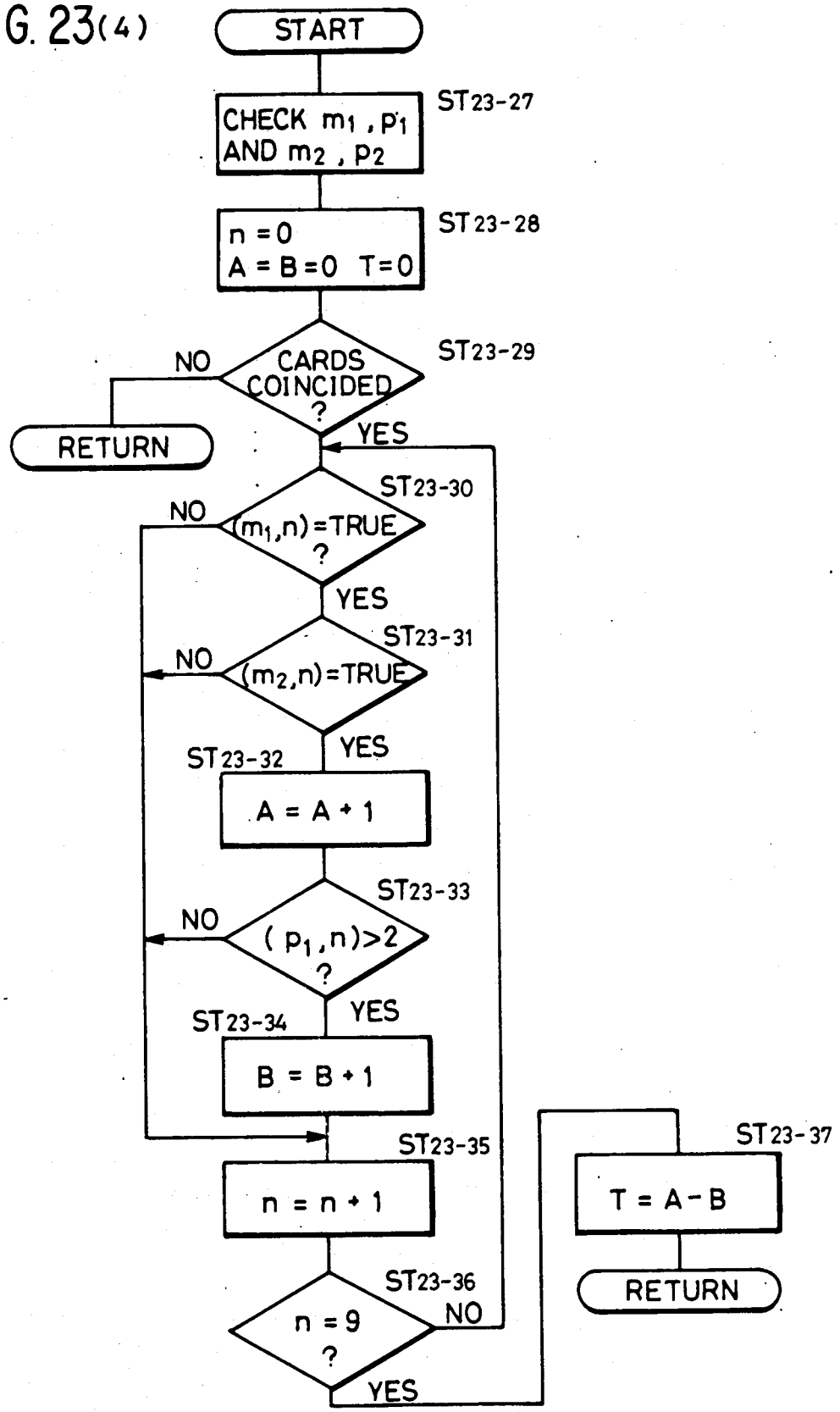
Figure 23:
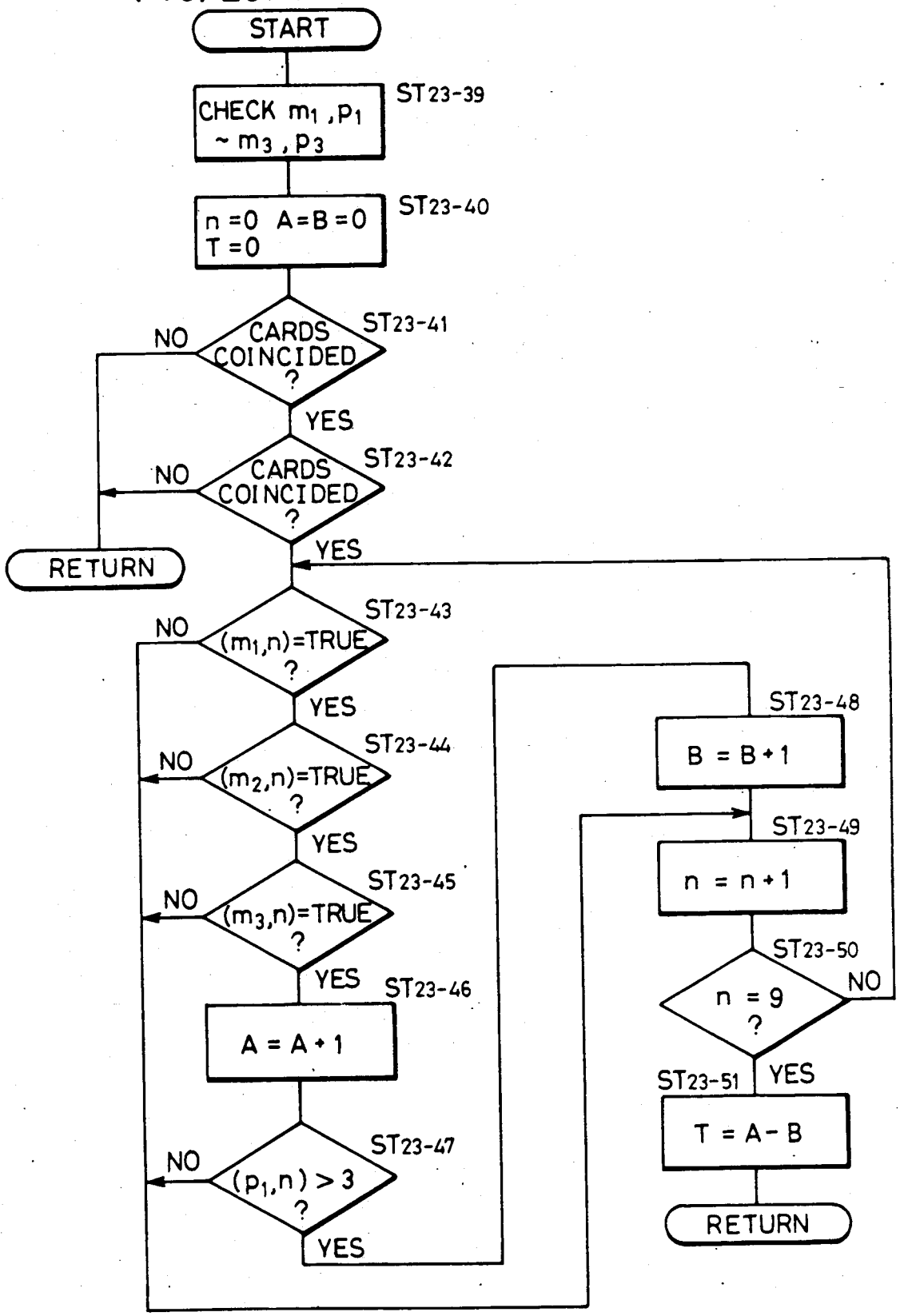
Figure 23:
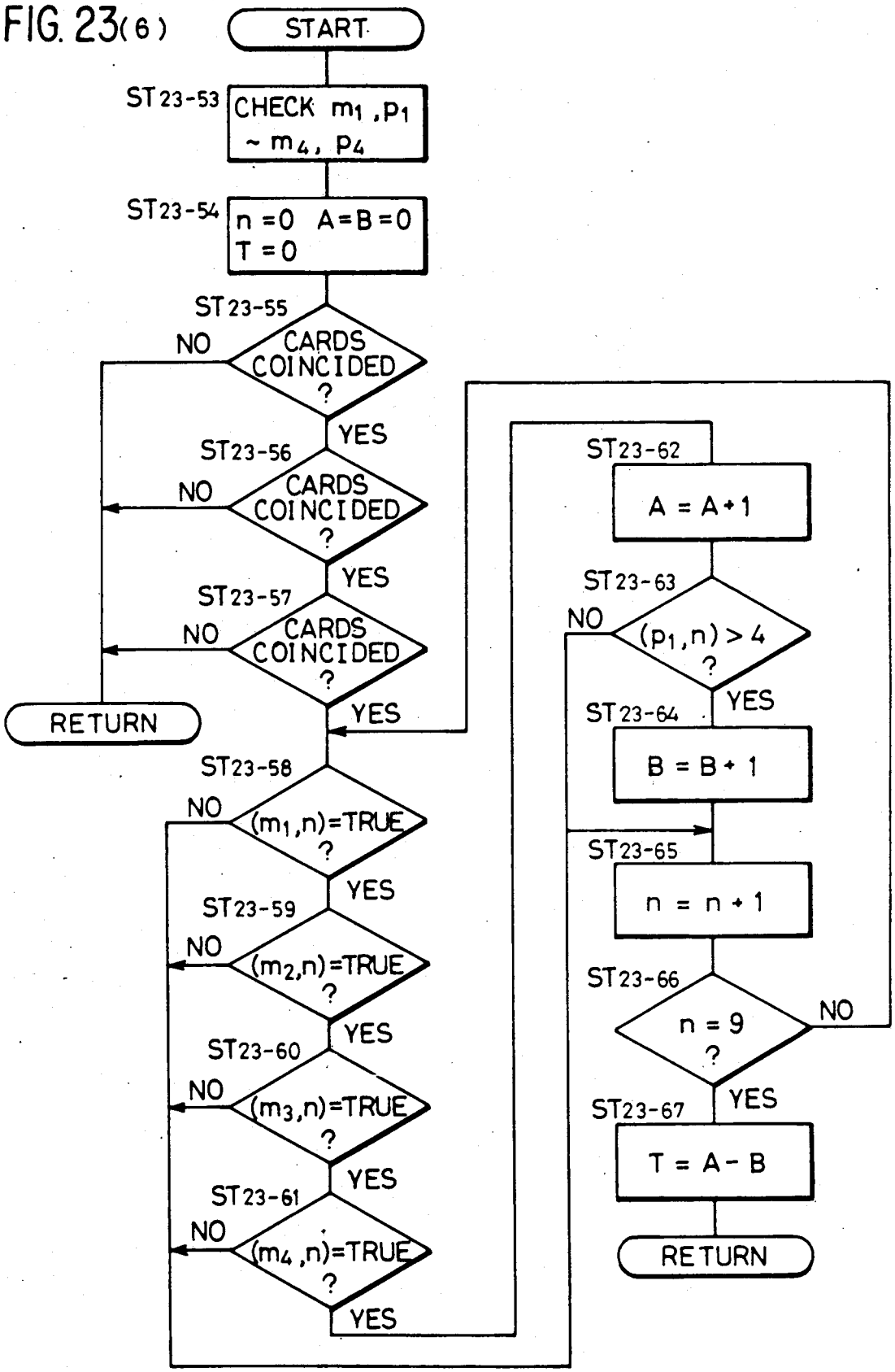
Figure 23:
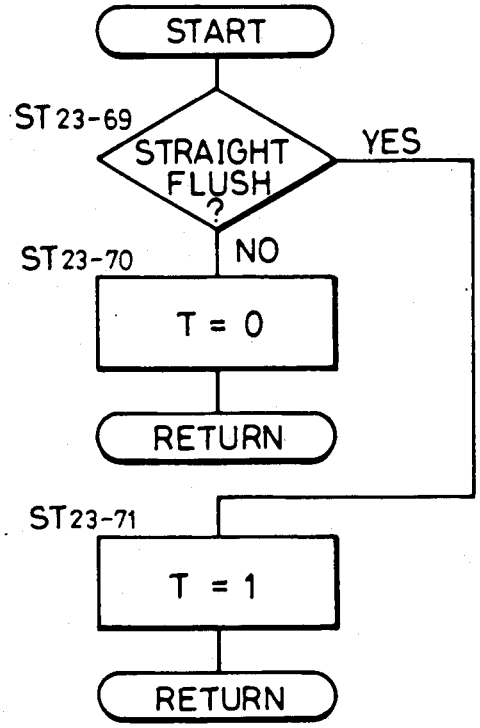

FIGS. 23 (1)-(7) show the detail of Step 12-7 in FIG. 12 or calculating procedures of the appearing frequency of "Straight Flush" for each holding made. Also FIGS. 24 (1), (2) show digital areas in the RAM20 used for executing the calculating procedure.

The digital area shown in FIG. 24 (1) is divided into 13 lines ×9 rows, and a total of 117 first Straight-Flush counters (hereinafter referred to as first counter ) $CT_{SF1}$ are provided. A direction of line of the digital area is corresponded to the card read, and a direction of row thereof is corresponded to the card combination pattern respectively. Positions of respective counters are regulated by each of the coordinates (m, n) set in the line and row.

The digital area shown in FIG. 24 (2) is divided into 4 lines ×9 rows, and a total of 36 second Straight-Flush counters (hereinafter referred to as second counter) $CT_{SF2}$ are provided. A direction of line of the digital area is corresponded to the kind of cards, and a direction of row thereof is corresponded to the card combination pattern respectively. Positions of respective counters are regulated by each of the coordinates (p,n) set in the line and row.

First, in Step 23-1 of FIG. 23 (1), all first counters $CT_{SF1}$ are set in the "False" condition, and in the nest Step 23-2, all second counters $CT_{SF2}$ are set to "0". These initial setting conditions are shown in FIGS. 24 (1), (2).

In the next Step 23-3, the rank and kind of the first card are checked, in the following Step 23-4, the first counter $CT_{SF1}$ corresponding to the rank is set in the "True" condition, and in the succeeding Step 23-5, the content of the second counter $CT_{SF2}$ corresponding to the kind and rank is incremented.

The same processings are repeated on 5 cards, for example, if the 5 cards are "8 of heart", "8 of diamond", "10 of diamond", "11 (Jack) of diamond" and "13 (King) of diamond", each of the digital areas of FIGS.

24 (1), (2) are in the data setting condition as shown in FIGS. 25 (1) (2).

If it is "YES" in Step 23-6, in Step 23-7, first the calculating procedure shown in FIG. 23 (2) of the appearing frequency of "Straight Flush" for the holding mode of C-0 is executed.

In Step 23-8 of FIG. 23 (2), data "36" is set in the working area storing the calculation value T, and in the next Step 23-9, the line counter p and row counter n for regulating the second counter $CT_{SF2}$ position are set to zero. "36" described above is a numeral indicating the possibility of establishing "Straight Flush".

In the next Step 23-10, it is determined whether the content of the second counter $CT_{SF2}$ at coordinates (p, n) (in this case 0,0) is zero, if "NO", in Step 23-11, the calculating value T is decremented, and if "YES", Step 23-11 is skipped. In an example shown in FIG. 25 (2), since the second counter $CT_{SF2}$ at coordinates (0,0) is zero, Step 23-11 is skipped. By repeating the same procedure as aforementioned in Step 23-12 as incrementing the row counter n, the content of the second counter $CT_{SF2}$ at respective positions from the coordinates (0,0) to (0,9) is checked and the calculation value T is renewed (Step 23-13).

After completing the first row, in Step 23-14, the line counter p is incremented and the row counter n is set to zero. The content of the second counter $CT_{SF2}$ in the next line is checked in the same manner and the calculation value T is renewed.

In the example shown in FIG. 25 (2), since there are 11 second counters $CT_{SF2}$ which are not zero, when it is "YES" in Step 23-15, the calculation value is 36-11=25, thereby the appearing frequency of "Straight Flush" for the holding mode of C-0 is obtained.

Then, in Step 23-16, the calculating procedure shown in FIG. 23 (3) of the appearing frequency of "Straight Flush" for the holding modes of C-1-C-5 is executed.

In Step 23-17 of FIG. 23 (3), first the rank $m_1$ and kind $p_1$ of one card held are checked and their data are retained. For example, if the card held is "8 of heart", $m_1=6$ and $p_1=0$. Next, in Step 23-18, zero is set in the row counter n, and the working area storing the calculation value T and the working area storing the intermediate values A, B under calculation are cleared.

In the next Step 23-19, whether the content of the first counter $CT_{SF1}$ at the position of coordinates ($m_1$, n) (in this case 0,0) is in the "True" condition is checked, if it is determined "Yes", the intermediate value A is incremented. Also, in the next Step 23-21, whether the content of the second counter $CT_{SF2}$ at the position of coordinates ($p_1$, n) is larger than 1 is checked, if it is determined "YES", the intermediate value B is incremented.

By executing the same procedure as aforementioned in the next Step 23-24 as incrementing the row counter n, the contents of respective first and second counters $CT_{SF1}$, $CT_{SF2}$ from the coordinates (0,0) to (0,9) are checked and the intermediate values A, B are renewed. When it is determined "YES" in Step 23-24, the calculation value T is calculated by subtracting the intermediate value B from the intermediate value A (Step 23-25).

In the example shown in FIG. 25 (2), for example, if the card held is "8 of heart", though 5 first counter $CT_{SF1}$ of "True" exist in the sixth line, the second counter $CT_{SF2}$ knowing the larger value than 1 does not exist at all in 0th line, so that when it is "YES" in Step 23-24, A=5 and B=0, thus the calculation value T is 5-0=5, thereby the appearing frequency of "Straight Flush" when "8 of heart" is held can be obtained.

It is also possible to calculate the appearing frequency of "Straight Flush" by exceeding the same procedure when the other card has been held.

Then, the calculating procedures of the appearing frequency of "Straight Flush" are executed similarly respectively for the holding modes of C-6-C-15 in Step 21-26 as shown particularly in FIG. 23 (4), for the holding molds of C-16-C-25 in Step 21-38 as shown particularly in FIG. 23 (5), for the holding modes of C-26-C-30 in Step 21-52 as shown particularly in FIG. 23 (6) and the holding mode of C-31 in Step 21-68 as shown particularly in FIG. 23 (7).

In these respective procedures, when kinds of two or more cards held are not coincided, since these is no more chance for "Straight Flush" to appear, the appearing frequency is zero. It is determined such that in Step 25-29 of FIG. 23 (4), the kinds of 2 cards are coincided, in Steps 23-41 and 23-42 of FIG. 23 (5), the kinds of 2-3 cards are coincided card in Steps 23-55, 23-56 and 23-57 of FIG. 23 (6), the kinds of 2-4 cards are coincided, if it is determined that they do not coincide, the calculation value T is kept zero and the data are not renewed.

When 5 cards are held, whether the card combination pattern constituted "Straight Flush" may be determined to set the appearing frequency to zero or 1 as shown in FIG. 23 (7).

FIG. 26 shows the calculation result aforementioned when the 5 cards are "8 of heart", "8 of diamond", "10 of diamond" "11 (Jack) of diamond" and "13 (King) of diamond".

Figure 27:
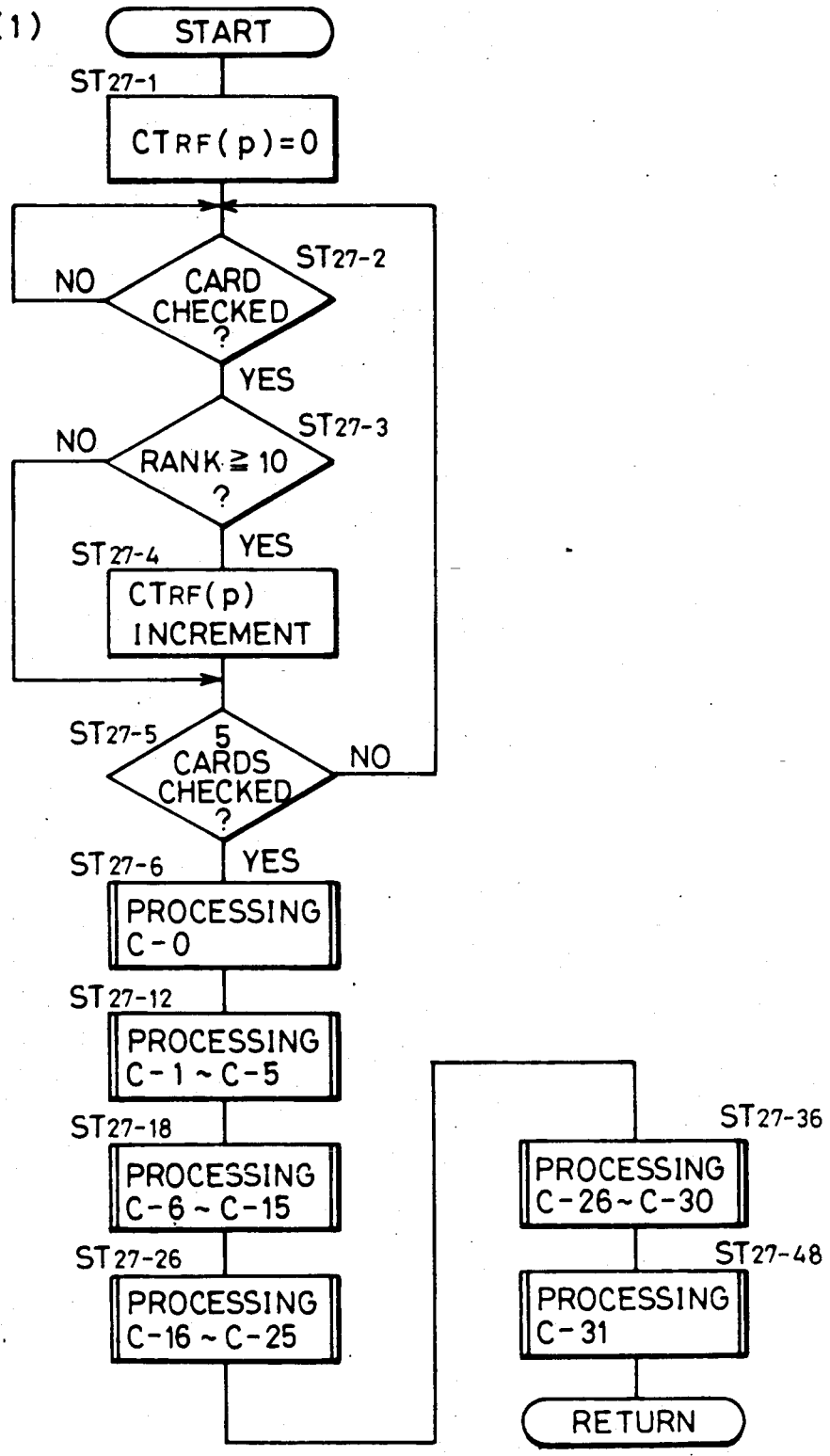
Figure 27:
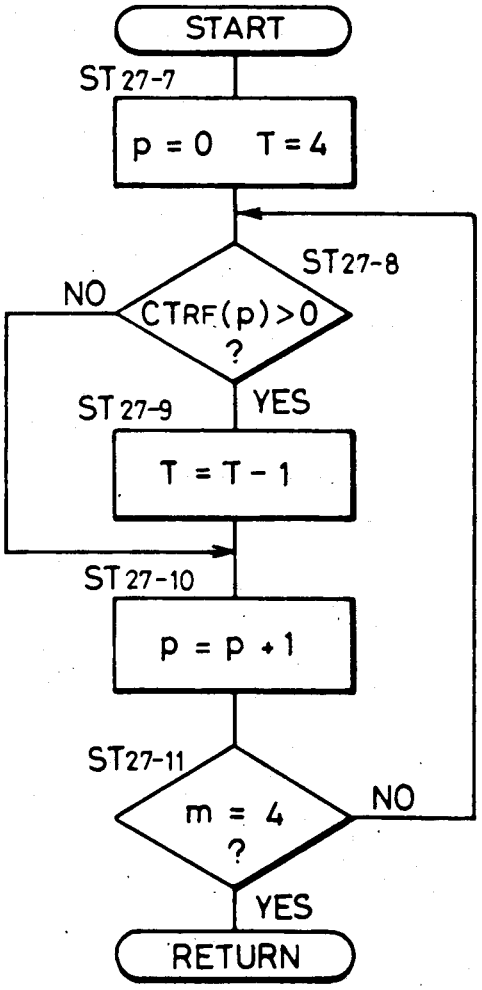
Figure 27:
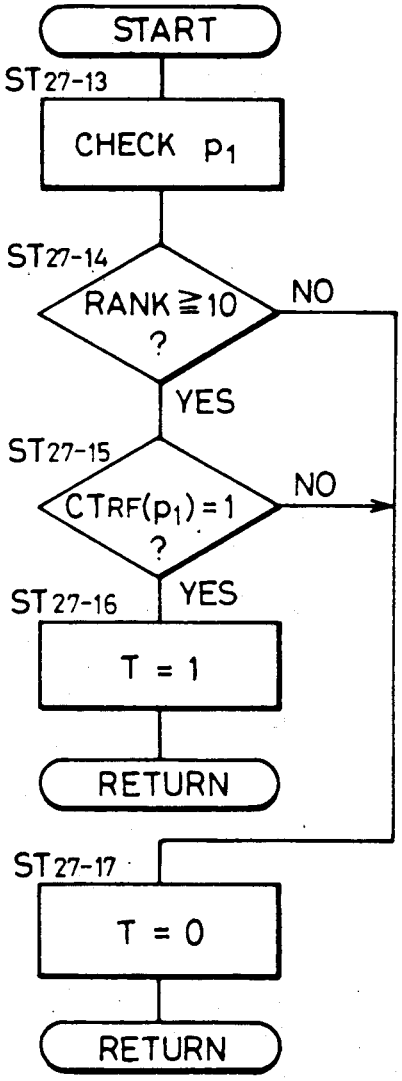
Figure 27:
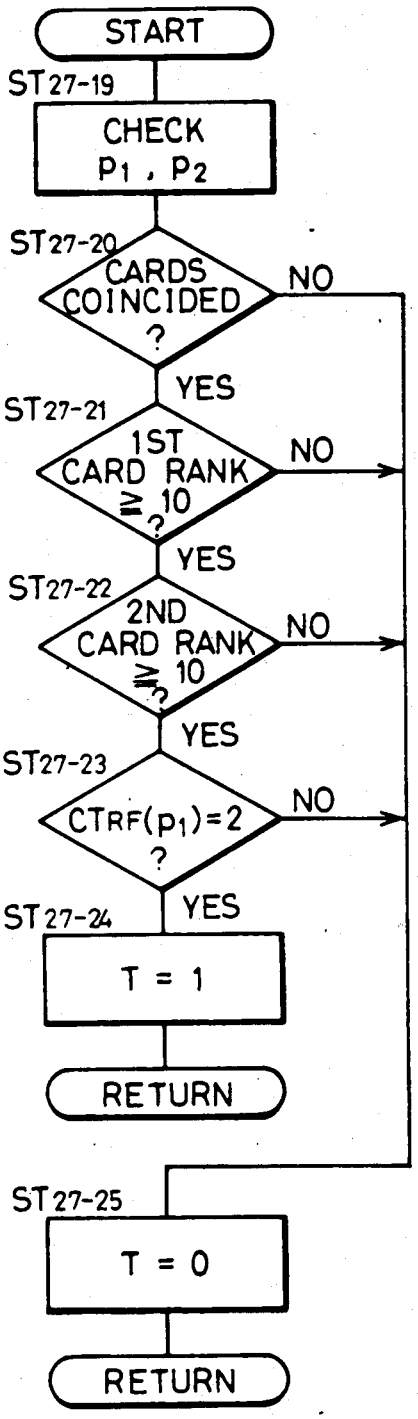
Figure 27:
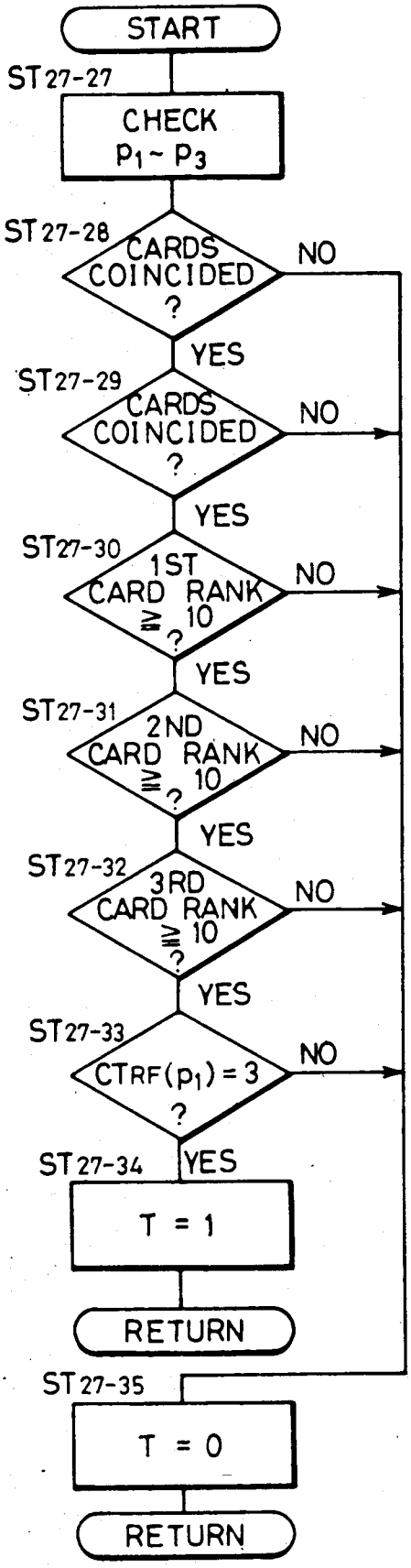
Figure 27:
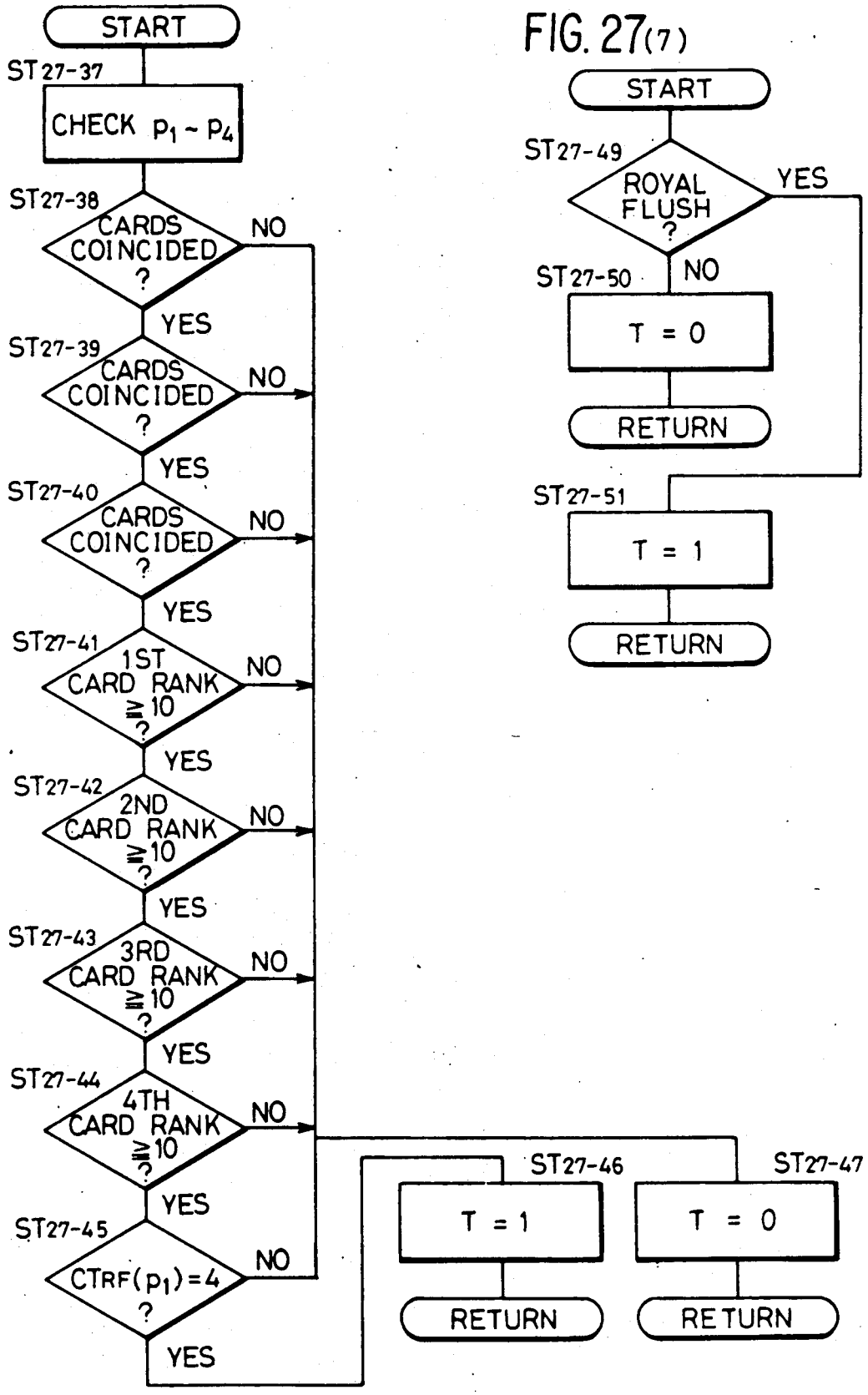

FIGS. 27 (1)-(7) show the detail of Step 12-8 in FIG. 12, or the calculating procedure of the appearing frequency of "Royal Flush" for each holding mode.

First, in Step 27-1 of FIG. 27 (1), the four Royal Flush Counters $CT_{RF}(p)$ for every kinds of card set in the CPU18 or RAM20 are set to zero.

In the next Step 27-2, the rank and kind for the first card are checked and it is determined in the following Step 27-3 whether the rank is above 10. If it is "YES" in Step 27-3, the content of the counter $CT_{RF}(p)$ corresponding to the kind of card is incremented.

Though the same processing is repeatedly executed for 5 cards, for example, when the 5 cards are "8 of heart", "8 of diamond", "10 of diamond", "11 (Jack) of diamond" and "13 (King) of diamond" only the content of the counter $CT_{RF}(1)$ for diamond (p=1)becomes "3" and the contents of respective counters $CT_{RF}(0)$, $CT_{RF}(2)$ and $CT_{RF}(3)$ for heart (p=0), club (p=2) and spade (p=3) are kept in zero.

When it is "YES" in Step 27-5, in the next Step 27-6, first the calculating procedure shown in FIG. 27 (2) of the appearing frequency of "Royal Flush" for the holding mode of C-0 is executed.

In Step 27-7 of FIG. 27 (2), data "4" is set in the working area storing the calculation value T, and zero is set in an assorting counter p regulating the kind of cards to nominate heart. "4" represents a numeral indicating the possibility of establishing "Royal Flush".

In the next Step 27-8, it is determined whether the content of the counter $CT_{RF}(0)$ for heart is larger than 0, and in this case, since it is "NO" the procedure is advanced to Step 27-10 skipping Step 27-9.

In Step 27-10, the assorting counter p is incremented nominating diamond and executing the same procedure as aforementioned. In the example aforementioned, since the content $CT_{RF}(1)$ is "3", it is determined "YES" in Step 27-8 and the calculation value T is incremented in Step 27-10.

Similarly, in Step 27-10, the assorting counter p is incremented nominating club and spade and executing the same procedures as above. In the case of aforesaid example, since the contents of $CT_{RF}(2)$ and $CT_{RF}(3)$ are "0", it is determined "NO" in Step 27-8 and Step 27-10 is skipped.

When it is determined "YES" in Step 27-11, the calculation value T becomes "3", thereby the appearing frequency of "Royal Flush" for the holding mode C-0 is obtained.

In the next Step 27-12, the calculating procedure shown in FIG. 27 (3) of the appearing frequency of "Royal Flush" for the holding modes C-1–C-5 is executed.

In Step 27-13 of FIG. 27 (3), first the kind $p_1$ and rank of a card held are checked and their data are retained. For example, if the card held is "8 of heart", $p_1=0$ and the rank is "8". Then, in Step 27-14, whether the rank is above 10 is determined and in the following Step 27-15, whether the content of counter $CT_{RF}(0)$ for heart is 1 is determined. In this case, since, both Steps 27-14 and 27-15 are "NO", the procedure is advanced to Step 27-17 to set the calculation value T to zero, thereby the appearing frequency of "Royal Flush" when holding "8 of heart" is obtained.

The same procedure is executed for the cases wherein the other cards are held to calculate the appearing frequency of "Royal Flush".

Then, the calculating procedures of the appearing frequency of "Royal Flush" are executed similarly respectively for the holding modes of C-6–C-15 in Step 27-18 as shown particularly in FIG. 27 (4), for the holding modes of C-16–C-25 in Step 27-26 as shown particularly in FIG. 27 (5), for the holding modes of C-26–C-30 in Step 27-36 as shown particularly in FIG. 27 (6) and for the holding mode of C-31 in Step 27-48 as shown particularly in FIG. 27 (7).

In these respective procedures, when kinds of two or more cards are not coincided, since there is no more chance for "Royal Flush" to appear, the appearing frequency is zero. It is determined such that in Step 27-20 of FIG. 27 (4), the kinds of two cards are coincided, in Steps 27-28 and 27-29 of FIG. 27 (5), the kinds of 2–3 cards are coincided and in Steps 27-38, 27-39 and 27-40 of FIG. 27 (6), the kinds of 2–4 cards are coincided, if it is determined that they do not coincide, the calculation value T is set to zero.

When 5 cards are held, whether the card combination pattern constitutes "Royal Flush" may be determined to set the appearing frequency to zero or 1 as shown in FIG. 27 (7).

As described in detail heretofore, when playing a symbol assorting game by holding one or more symbols among a predetermined number of displayed symbol and replacing the rest with the other symbols, since it was made possible to calculate the optimum holding object in response to probability calculations to instruct to the player, an interest of the game is stimulated not only for a proficient but also for a beginner and it can be mastered in a short time.

Besides, if it is designed to receive instructions from the machine responsive to the demanding operation of the player, the game can be brought in correspondence with the proficiency and taste of the player without forcing the instruction.

Moreover, when the optimum holding object is instructed to the player by a method of distinguishing from the other symbols visually, the player can grasp the instruction clearly and instantaneously.

Furthermore, when the probability calculation is executed utilizing precalculated fixed data effectively, the calculation speed can be reduced considerably for a prompt instruction.

While the present invention has been described with reference to the preferred embodiment, it will be understood by those skilled in the art that various changes and modifications may be made without departing from the spirit of the present invention. The scope of the present invention is therefore to be determined solely by the appended claims.

We claim:

1. A symbol assorting gaming machine comprising:

displaying means for displaying a first predetermined number of first display symbols selected from a group of a second predetermined number of various symbols, said second number being greater than said first number; holding means for selectively holding one or more of said first display symbols on said display;

a first operator control;

replacing means responsive to operation of said first operator control for replacing the first display symbols other than those being held with the other symbols extracted for display from said group of various symbols to provide a resultant display that includes said held display symbols and said other symbols;

judging means for judging whether the resultant display symbol combination pattern after replacement coincides with a symbol combination pattern related to winning;

calculating means for determining an optimum symbol combination of a number of symbols equal to said first predetermined number of said various symbols from all of the symbols of said group of various symbols, that includes at least one of said first display symbols, for determining the symbol combination that has the greatest probability of corresponding to a symbol pattern related to winning;

a second operator control; and training means responsive to said calculating means and operation of said second operator control for displaying said optimum symbol combination to train a user of the gaming machine.

2. A symbol assorting gaming machine in accordance with claim 1, wherein said instructing means comprises means for showing the user an optimum symbol combination among a plurality of said display symbols displayed by said displaying means by distinguishing them visually from the other symbols.

3. A symbol assorting gaming machine comprising:

displaying means for displaying a first predetermined number of first display symbols selected from a group of a second predetermined number of various symbols, said second number being larger than said first number;

holding means for selectively holding one or more of the first display symbols on said display;

a first operator control;

replacing means responsive to operation of said first operator control for replacing the first display symbols other than those being held with the other symbols extracted for display from said group of various symbols to provide a resultant display that includes said held display symbols and said other symbols;

judging means for judging whether the resultant display symbol combination pattern after replacement coincides with a symbol combination pattern related to winning;

calculating means for determining the optimum symbol combination of a number of symbols equal to said first predetermined number of said various symbols from all of the symbols of said group of various symbols, that includes at least one of said first display symbols for determining the symbol combination that has the greatest probability of corresponding to a symbol pattern related to winning;

operating means including a second operator control for controlling said calculating means to determine said optimum symbol combination; and training means responsive to said calculating means and operation of said second operator control for displaying said optimum combination to train a user of the machine.

4. A symbol assorting gaming machine in accordance with claim 3, wherein said instructing means comprises means for showing the user an optimum symbol combination among a plurality of said display symbols displayed by said displaying means by distinguishing them visually from the other symbols.

5. A symbol assorting gaming machine comprising:

displaying means for displaying a first predetermined number of first display symbols selected from a group of a second predetermined number of various symbols, said second number being greater than said first number;

holding means for selectively holding one or more of said first display symbols on said display;

replacing means for replacing the first display symbols other than those being held with the other symbols extracted for display from said group of various symbols to provide a resultant display that includes said held display symbols and said other symbols;

judging means for judging whether the resultant display symbol combination pattern after replacement coincides with a symbol combination pattern related to winning;

calculating means for determining an optimum symbol combination of said various symbols, that includes at least one of said first display symbols, for determining the symbol combination that has the greatest probability of corresponding to a symbol pattern related to winning; and instructing means responsive to said calculating means for displaying said optimum symbol combination to instruct a user of the gaming machine, said calculating means including means for storing fixed data and memory means for storing fixed data obtained by said means for calculating fixed data;

said calculating means for determining an optimum symbol combination comprising first calculating means for executing a first part of a probability calculation by reading out the fixed data from the memory means, and second calculating means for executing a further part of said probability calculation by executing a predetermined calculating procedure.

6. A symbol assorting gaming machine comprising:

displaying means for displaying a first predetermined number of first display symbols selected from a group of a second predetermined number of various symbols, said second number being larger than said first number;

holding means for selectively holding one or more of the first display symbols on said display;

replacing means for replacing the first display symbols other than those being held with the other symbols extracted for display from said group of various symbols to provide a resultant display that includes said held display symbols and said other symbols;

judging means for judging whether the resultant display symbol combination pattern after replacement coincides with a symbol combination pattern related to winning;

calculating means for determining the optimum symbol combination of said various symbols, that includes at least one of said first display symbols for determining the symbol combination that has the greatest probability of corresponding to a symbol pattern related to winning;

instructing means responsive to said calculating means for displaying said optimum combination to instruct a user of the machine; and operating means for controlling said calculating means to determine said optimum symbol combination, said calculating means including means for calculating fixed data and memory means for storing fixed data obtained by said means for calculating fixed data;

said calculating means for determining an optimum symbol combination comprising first calculating means for executing a first part of a probability calculation by reading out the fixed data from the memory means, and second calculating means for executing a further part of said probability calculation by executing a predetermined calculating procedure.

* * * * *